US009393796B2

(12) United States Patent
Kondo et al.

(10) Patent No.: US 9,393,796 B2
(45) Date of Patent: Jul. 19, 2016

(54) LIQUID CARTRIDGE

(71) Applicant: BROTHER KOGYO KABUSHIKI KAISHA, Nagoya-shi, Aichi-ken (JP)

(72) Inventors: Hirofumi Kondo, Aichi-ken (JP); Kenta Hayashida, Inazawa (JP); Taro Nagano, Nagoya (JP); Ayako Ohishi, Nagoya (JP); Suguru Tomoguchi, Okazaki (JP); Hiroto Sugahara, Ama (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/508,662

(22) Filed: Oct. 7, 2014

(65) Prior Publication Data

US 2016/0052285 A1 Feb. 25, 2016

(30) Foreign Application Priority Data

Aug. 19, 2014 (EP) ..... 14181448

(51) Int. Cl.
*B41J 2/01* (2006.01)
*B41J 2/175* (2006.01)

(52) U.S. Cl.
CPC ..... *B41J 2/17523* (2013.01); *B41J 2/17513* (2013.01)

(58) Field of Classification Search
CPC ..... B41J 2/17523
USPC ..... 347/7, 87, 85, 86
See application file for complete search history.

(56) References Cited

U.S. PATENT DOCUMENTS

| | | | | |
|---|---|---|---|---|
| 4,862,192 | A | 8/1989 | Slomianny | |
| 5,997,121 | A | 12/1999 | Altfather et al. | |
| 6,095,643 | A | 8/2000 | Cook et al. | |
| 6,286,921 | B1 | 9/2001 | Ochi et al. | |
| 8,007,094 | B2 * | 8/2011 | Ujita | 347/87 |
| 2002/0122082 | A1 | 9/2002 | Ardito et al. | |
| 2007/0236546 | A1 | 10/2007 | Sugahara | |

(Continued)

FOREIGN PATENT DOCUMENTS

| | | | |
|---|---|---|---|
| DE | 4411873 | A1 | 10/1994 |
| DE | 29624275 | U1 | 7/2001 |

(Continued)

OTHER PUBLICATIONS

European Search Report issued in related application EP 14 18 1446. 7, Feb. 2, 2015.

(Continued)

*Primary Examiner* — Lam Nguyen
(74) *Attorney, Agent, or Firm* — Merchant & Gould P.C.

(57) ABSTRACT

A liquid cartridge includes a liquid chamber configured to store liquid therein, a liquid supply portion configured to supply the liquid from the liquid chamber to the outside of the liquid cartridge, an air communication portion configured to bring the liquid chamber into communication with the atmosphere outside the liquid cartridge, and a capillary portion having a first end configured to be in communication with the liquid chamber and a second end configured to be in communication with the atmosphere outside the liquid cartridge. The capillary portion is configured to move the liquid from the first end to the second end therethrough by capillary force when the liquid chamber is brought into communication with the atmosphere outside the liquid cartridge via the air communication portion.

20 Claims, 12 Drawing Sheets

(56) References Cited

U.S. PATENT DOCUMENTS

| | | | |
|---|---|---|---|
| 2007/0236549 | A1 | 10/2007 | Yamada |
| 2008/0174644 | A1 | 7/2008 | Hongo et al. |
| 2008/0231676 | A1 | 9/2008 | Shimizu |
| 2009/0015640 | A1 | 1/2009 | Nishida et al. |
| 2010/0238241 | A1 | 9/2010 | Sasaki |
| 2012/0274711 | A1 | 11/2012 | Murray |

FOREIGN PATENT DOCUMENTS

| | | | |
|---|---|---|---|
| DE | 10202365 | A1 | 7/2003 |
| EP | 0 712 727 | A2 | 5/1996 |
| EP | 0282049 | A2 | 9/1998 |
| EP | 0 956 959 | A2 | 11/1999 |
| EP | 1 170 135 | A1 | 1/2002 |
| EP | 1 254 775 | A2 | 11/2002 |
| EP | 1 359 026 | A1 | 5/2003 |
| EP | 1 336 498 | A1 | 8/2003 |
| EP | 2 060 397 | A2 | 5/2009 |
| JP | 2-57945 | A | 2/1990 |
| JP | 9-277560 | A | 10/1997 |

OTHER PUBLICATIONS

European Search Report issued in related application EP 14 18 1448.3, Feb. 15, 2015.

Office Action issued in related U.S. Appl. No. 14/508,733, mailed Jul. 16, 2015.

Office Action issued in related German Patent Application Serial No. 10 2015 203 334.1, mailed Feb. 12, 2016.

Office Action issued in related German Patent Application Serial No. 10 2015 203 336.8, mailed Feb. 12, 2016.

U.S. Office Action issued in related U.S. Appl. No. 14/508,733, mailed Jan. 5, 2016.

Office Action (Notice of Allowance) issued in related U.S. Appl. No. 14/508,733, mailed Mar. 28, 2016.

* cited by examiner

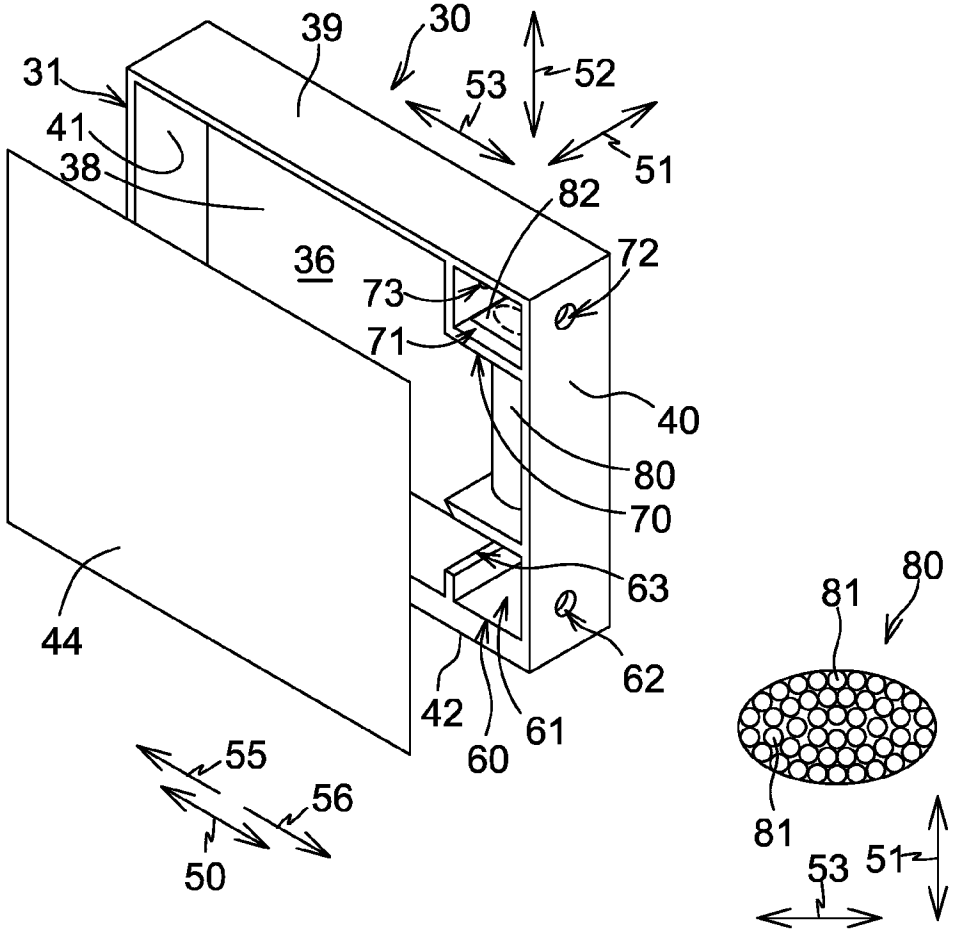
Fig.3C
Fig.3B
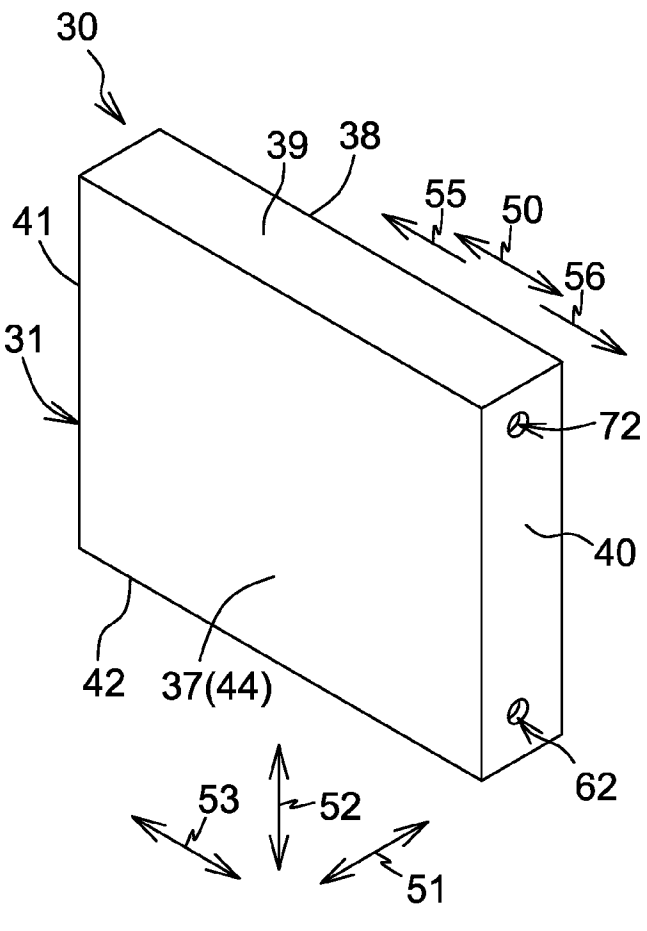
Fig.3A

LIQUID CARTRIDGE

CROSS-REFERENCE TO RELATED APPLICATION

The present application claims priority to and the benefit of European Patent Application No. 14181448.3, which was filed on Aug. 19, 2014, the disclosure of which is incorporated herein by reference in its entirety.

BACKGROUND OF THE INVENTION

1. Field of the Invention

The present invention relates to a liquid cartridge.

2. Description of Related Art

A known ink jet recording apparatus is configured to record an image on a recording medium by ejecting ink stored in an ink container from nozzles. The viscosity of ink stored in the ink container may change over time. A known ink-jet recording apparatus, as described in Patent Application Publication No. JP-09-277560 A, is configured to estimate the viscosity of ink stored in an ink container, and perform optimized preliminary ejection based on the result of the estimation. More specifically, the ink-jet recording apparatus is configured to estimate the viscosity of ink based on an elapsed time since the ink container is mounted to the ink-jet recording apparatus and an amount of ink remaining in the ink container. Nevertheless, this known ink-jet recording apparatus does not estimate the viscosity by directly measuring a physical quantity obtained when ink moves in the ink container. Moreover, this known ink-jet recording apparatus cannot estimate the viscosity of ink stored in an ink container which has not been mounted to the ink-jet recording apparatus and been unused.

SUMMARY OF THE INVENTION

Therefore, a need has arisen for a liquid cartridge which overcomes these and other shortcomings of the related art. A technical advantage of the present invention is that the viscosity of liquid stored in a liquid cartridge may be estimated by more direct measurement.

According to an aspect of the present invention, a liquid cartridge comprises a liquid chamber configured to store liquid therein, an air communication portion configured to selectively bring the liquid chamber into communication with the atmosphere outside the liquid cartridge, and a capillary portion having a first end configured to be in communication with the liquid chamber and a second end configured to be in communication with the atmosphere outside the liquid cartridge. The capillary portion is configured to move the liquid from the first end to the second end therethrough by capillary force when the liquid chamber is brought into communication with the atmosphere outside the liquid cartridge via the air communication portion.

With this configuration, the velocity of the liquid moving in the capillary portion varies depending on the viscosity of liquid in the liquid chamber. By measuring a physical quantity, based on which the velocity of the liquid can be specified, the viscosity of liquid stored in the liquid chamber may be estimated.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

FIG. 3A is a perspective view of the ink cartridge, in which a film is welded to a frame. FIG. 3B is an exploded perspective view of the ink cartridge, in which the film is removed from the frame. FIG. 3C is a cross-sectional view of a capillary portion taken along a plane parallel with a width direction and a depth direction.

DETAILED DESCRIPTION OF EMBODIMENTS OF THE INVENTION

Embodiments of the present invention, and their features and advantages, may be understood by referring to FIGS. 1-12B, like numerals being used for like corresponding parts in the various drawings.

[Printer 10]

Figure 1:
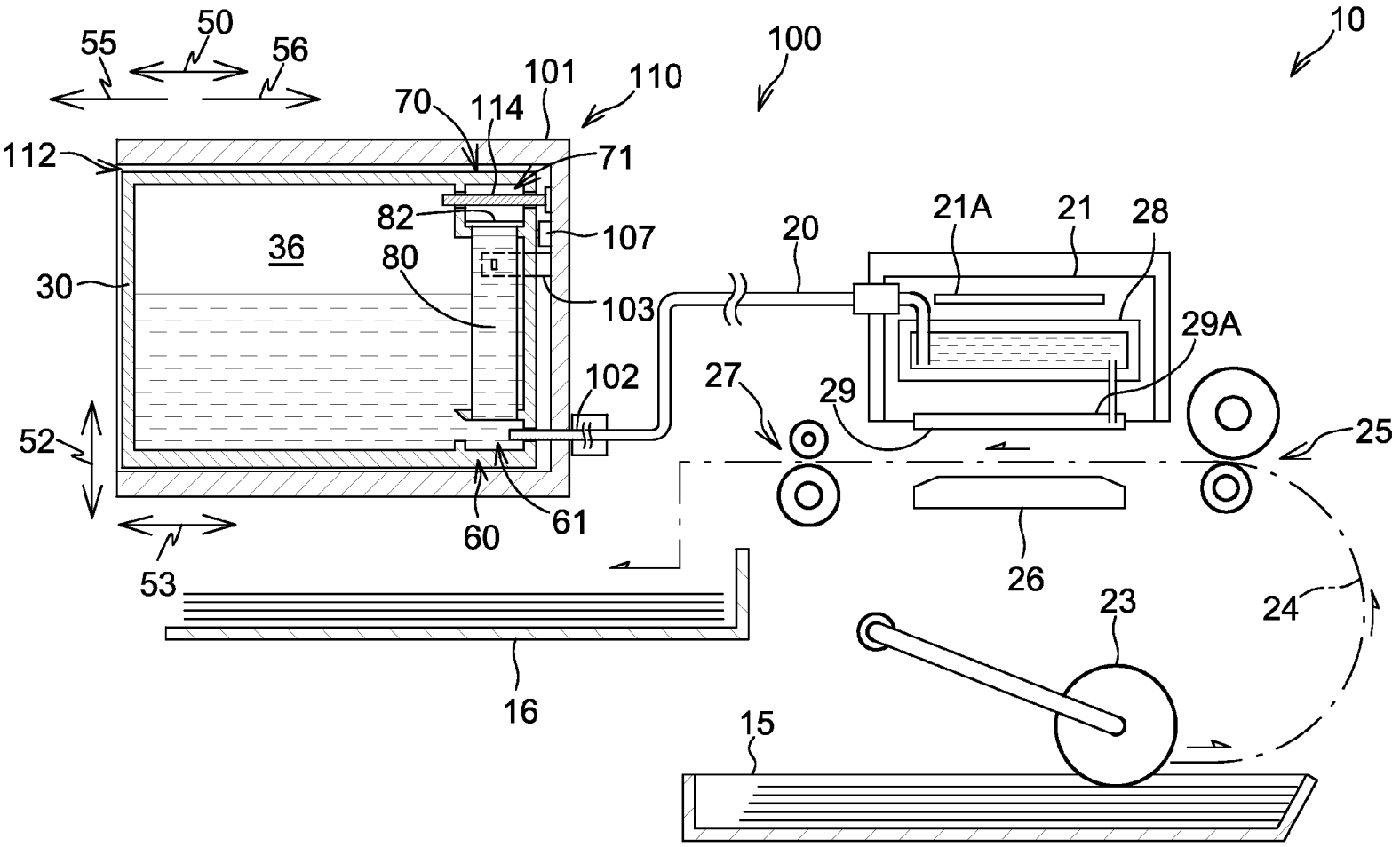
FIG. 1 is a schematic, cross-sectional view of a printer comprising a cartridge mounting portion and an ink cartridge, according to an embodiment of the present invention.

Referring to FIG. 1, a liquid consuming apparatus, e.g., a printer 10 is an inkjet printer configured to record an image on a sheet of recording paper by ejecting ink droplets selectively on the sheet of recording paper. The printer 10 comprises a liquid consuming portion, e.g., a recording head 21, an ink supply device 100, and an ink tube 20 connecting the recording head 21 and the ink supply device 100. The ink supply device 100 comprises a cartridge mounting portion 110. The cartridge mounting portion 110 is configured to allow a liquid container or a liquid cartridge, e.g., an ink cartridge 30 to be mounted therein. The cartridge mounting portion 110 has an opening 112 and the interior of the cartridge mounting portion 110 is exposed to the exterior of the cartridge mounting portion 110 via opening 112. The ink cartridge 30 is configured to be inserted into the cartridge mounting portion 110 via the opening 112 in an insertion direction 56, and to be removed from the cartridge mounting portion 110 via the opening 112 in a removal direction 55.

The ink cartridge 30 is configured to store ink, which is used by the printer 10. The ink cartridge 30 and the recording head 21 are fluidically connected via the ink tube 20 when mounting of the ink cartridge 30 to the cartridge mounting portion 110 has been completed. The recording head 21 comprises a sub tank 28. The sub tank 28 is configured to temporarily store ink supplied via the ink tube 20 from the ink cartridge 30. The recording head 21 comprises nozzles 29 and is configured to selectively eject ink supplied from the sub tank 28 through the nozzles 29. More specifically, the recording head 21 comprises a head control board 21A and piezoelectric actuators 29A corresponding to the nozzles 29, and the head control board 21A is configured to selectively apply driving voltage to the piezoelectric actuators 29A. As such, ink is ejected from the nozzles 29.

The printer 10 comprises a paper feed tray 15, a paper feed roller 23, a conveying roller pair 25, a platen 26, a discharge roller pair 27, and a discharge tray 16. A conveying path 24 is formed from the paper feed tray 15 up to the discharge tray 16 via the conveying roller pair 25, the platen 26, and the discharge roller pair 27. The paper feed roller 23 is configured to feed a sheet of recording paper from the paper feed tray 15 to the conveying path 24. The conveying roller pair 25 is configured to convey the sheet of recording paper fed from the paper feed tray 15 onto the platen 26. The recording head 21 is configured to selectively eject ink onto the sheet of recording paper passing over the platen 26. Accordingly, an image is recorded on the sheet of recording paper. The sheet of recording paper having passed over the platen 26 is discharged by the discharge roller pair 27 to the paper discharge tray 16 disposed at the most downstream side of the conveying path 24.

[Ink Supply Device 100]

Figure 2:
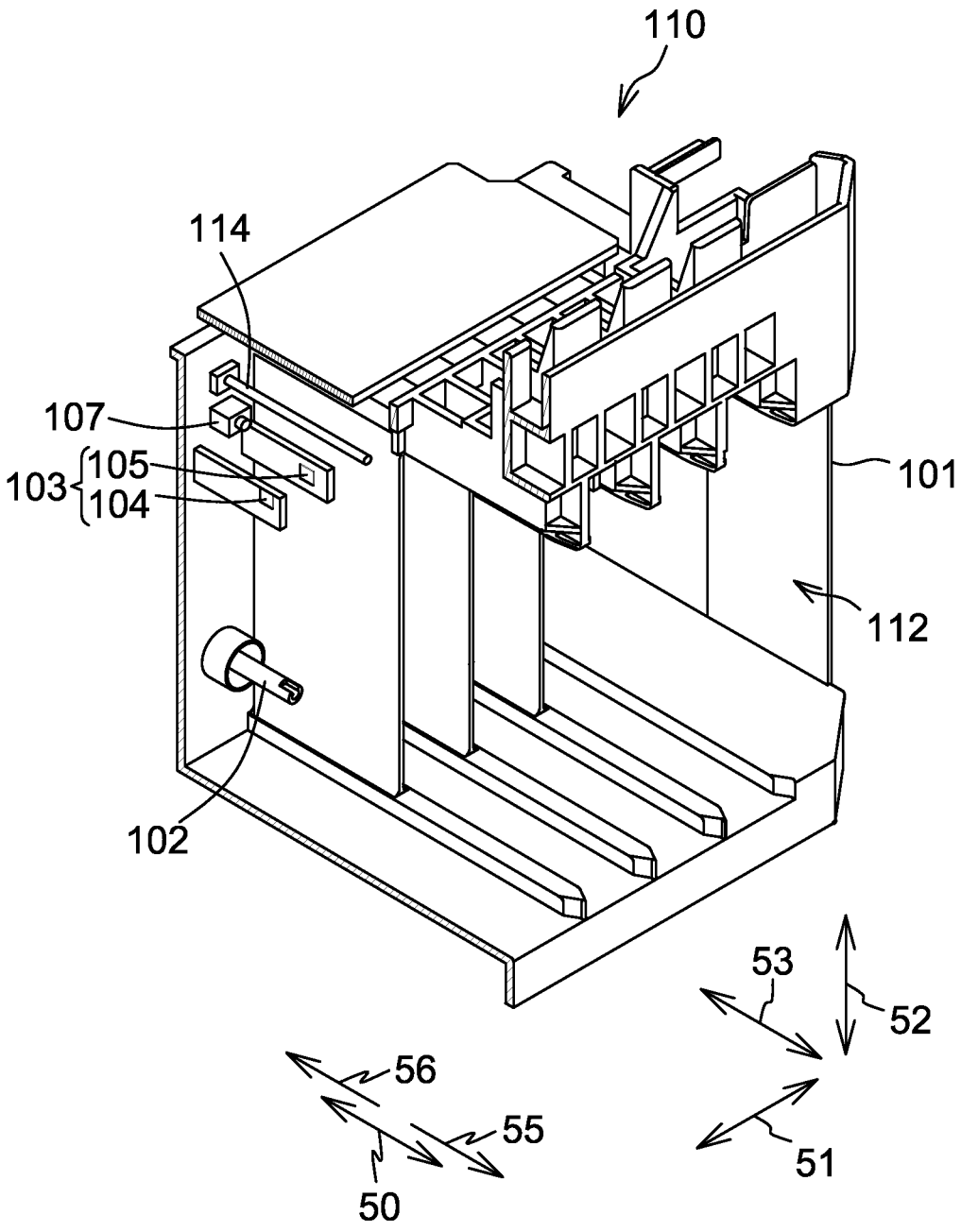
FIG. 2 is a perspective view of the cartridge mounting portion which is partly cut, showing an end surface of the cartridge mounting portion.

Referring to FIG. 1, the printer 10 comprises the ink supply device 100. The ink supply device 100 is configured to supply ink to the recording head 21. The ink supply device 100 comprises the cartridge mounting portion 110 to which the ink cartridge 30 is mountable. The cartridge mounting portion 110 comprises a case 101, a longitudinal object, e.g., a hollow tube 102, a detector, e.g., a sensor 103, a mount detector, e.g., a mount sensor 107, and a rod 114. In FIG. 1, mounting of the ink cartridge 30 to the cartridge mounting portion 110 has been completed. Referring to FIG. 2, the cartridge mounting portion 110 is configured to receive four ink cartridges 30 storing cyan, magenta, yellow, and black inks, respectively. Four hollow tubes 102, four sensors 103, four mount sensors 107, and four rods 114 are provided at the cartridge mounting portion 110, corresponding to the four ink cartridges 30.

[Hollow Tube 102]

The case 101 of the cartridge mounting portion 110 has the opening 112 formed through one face of the case 101. The case 101 comprises an end surface opposite the opening 112. Referring to FIGS. 1 and 2, the hollow tube 102 extends from the end surface of the case 101 in the removal direction 55. The hollow tube 102 is positioned at the end surface of the case 101 and at a position corresponding to an ink supply portion 60 (described later) of the ink cartridge 30. The hollow tube 102 is a resin tube having a liquid path formed therein. The hollow tube 102 has a proximal end and a distal end. The hollow tube 102 has an opening formed through a distal-end side of the hollow tube 102, and the ink tube 20 is connected to a proximal-end side of the hollow tube 102. The hollow tube 102 is configured to contact and move a portion of the ink cartridge 30 for allowing ink stored in the ink cartridge 30 to flow into the ink tube 20 via the hollow tube 102.

The printer 10 comprises a cover (not shown) configured to selectively cover the opening 112 of the cartridge mounting portion 110 and not cover the opening 112 such that the opening 112 is exposed to the exterior of the printer 10. The cover is supported by the case 101 or by an outer case of the printer 10 such that the cover can be selectively opened and closed. When the cover is opened, the opening 112 is exposed to the exterior of the printer 10. When the cover is opened, a user can insert the ink cartridge 30 into the cartridge mounting portion 110 through the opening 112 and can remove the ink cartridge 30 from the cartridge mounting portion 110 through the opening 112. When the cover is closed, the opening 112 is covered and the ink cartridge 30 cannot be inserted into or removed from the cartridge mounting portion 110.

In this description, when it is described that the ink cartridge 30 is mounted to the cartridge mounting portion 110, it means that at least a portion of the ink cartridge 30 is positioned in the cartridge mounting portion 110, more specifically, positioned in the case 101. Therefore, an ink cartridge 30 which is being inserted into the cartridge mounting portion 110 is also an example of an ink cartridge 30 mounted to the cartridge mounting portion 110. On the other hand, when it is described that the mounting of the ink cartridge 30 to the cartridge mounting portion 110 has been completed, it means that the ink cartridge 30 is in such a state that the printer 10 can perform image recording. For instance, when the ink cartridge 30 is in such a state, ink supply from the ink cartridge 30 to the recording head 21 is at least possible, and preferably the ink cartridge 30 is locked such that the movement of ink cartridge 30 relative to the cartridge mounting portion 110 is restricted or the ink cartridge 30 is positioned in the cartridge mounting portion 110 with the cover closed.

[Sensor 103]

Referring to FIG. 2, the sensor 103 is positioned above the hollow tube 102 and extends from the end surface of the case 101 in the removal direction 55. The sensor 103 comprises a light emitting portion 104 and a light receiving portion 105 aligned in a width direction 51. The light emitting portion 104 and the light receiving portion 105 face each other in the width direction 51. The light emitting portion 104 is configured to emit light, e.g., visible, infrared, and/or ultraviolet light, toward the light receiving portion 105, and the light receiving portion 105 is configured to receive the light emitted by the light emitting portion 104. When the mounting of the ink cartridge 30 to the cartridge mounting portion 110 has been completed, the ink cartridge 30 is positioned between the light emitting portion 104 and the light receiving portion 105. In other words, the light emitting portion 104 and the light receiving portion 105 are provided so as to face each other with the ink cartridge 30 positioned therebetween when the mounting of the ink cartridge 30 to the cartridge mounting portion 110 has been completed. More specifically, a capillary portion 80 (described later) of the ink cartridge 30 is positioned between the light emitting portion 104 and the light receiving portion 105 when the mounting of the ink cartridge 30 to the cartridge mounting portion 110 has been completed.

In this embodiment, a detection position is a position within the ink cartridge 30 which intersects an imaginary line extending between the light emitting portion 104 and the light receiving portion 105 when the mounting of the ink cartridge 30 to the cartridge mounting portion 100 has been completed. In other words, the detection position intersects an optical path extending between the light emitting portion 104 and the light receiving portion 105. In other words, the sensor 103 is positioned so as to face the detection position. In this embodiment, the sensor 103 is positioned so as to face the ink cartridge 30 when the mounting of the ink cartridge 30 to the cartridge mounting portion 110 has been completed. In another embodiment, the sensor 103 is positioned so as to face the ink cartridge 30 when the ink cartridge 30 is being inserted into the cartridge mounting portion 110. That is, the sensor 103 is positioned so as to face the ink cartridge 30 mounted to the cartridge mounting portion 110, and the detection position intersects the optical path extending between the light emitting portion 104 and the light receiving portion 105 when the ink cartridge 30 is mounted to the cartridge mounting portion 110.

The sensor 103 is configured to output different detection signals based on the intensity of light received by the light receiving portion 105. The sensor 103 is configured to output a Low-level signal, i.e., a signal whose level is less than a predetermined threshold value, when the intensity of light received by the light receiving portion 105 is less than a predetermined intensity. The sensor 103 is configured to output a High-level signal, i.e., a signal whose level is greater than or equal to the predetermined threshold value, when the intensity of light received by the light receiving portion 105 is greater than or equal to the predetermined intensity.

[Mount Sensor 107]

Referring to FIGS. 1 and 2, the mount sensor 107 is positioned in a mount detection position in an insertion path of the ink cartridge 30 in the cartridge mounting portion 110. The ink cartridge 30 moves in the insertion path when the ink cartridge 30 is inserted into the cartridge mounting portion 110. In this embodiment, the mount sensor 107 is positioned at the end surface of the case 101. The mount sensor 107 is configured to output different detection signals based on the presence or absence of the ink cartridge 30 in the mount detection position. In this embodiment, the mount sensor 107 is positioned, such that the ink cartridge 30 is positioned in the mount detection position when the mounting of the ink cartridge 30 to the cartridge mounting portion 100 has been completed.

In this embodiment, the mount sensor 107 is a mechanical sensor. When the mount sensor 107 is not pushed by a front wall 40 (described later) of the ink cartridge 30, the mount sensor 107 outputs a Low-level signal, indicating that the ink cartridge 30 is not in the mount detection position. When the mount sensor 107 is pushed by the front wall 40 of the ink cartridge 30, the mount sensor 107 outputs a High-level signal, indicating that the ink cartridge 30 is in the mount detection position. The mount sensor 107 is not limited to the mechanical sensor, but may be an optical sensor, an electric sensor, or any other known sensor.

[Rod 114]

Referring to FIGS. 1 and 2, the rod 114 is positioned above the hollow tube 102 and extends from the end surface of the case 101 in the removal direction 55. The rod 114 is positioned at the end surface of the case 101 and at a position corresponding to an air communication portion 70 (described later) of the ink cartridge 30. The rod 114 is configured to contact and move a portion of the ink cartridge 30 when the ink cartridge 30 is mounted to the cartridge mounting portion 110 for bringing the ink chamber 36 (described later) into communication with the atmosphere outside the ink cartridge 30.

[Ink Cartridge 30]

Referring to FIGS. 3A and 3B, the ink cartridge 30 comprises a frame 31 having a liquid chamber, e.g., an ink chamber 36 formed therein, and a liquid supply portion, e.g., an ink supply portion 60 formed therein, and an air communication portion 70 formed therein. The ink cartridge 30 is configured to supply ink stored in the ink chamber 36 to the outside of the ink cartridge 30 via the ink supply portion 60. The ink cartridge 30 is configured to be inserted into and removed from the cartridge mounting portion 110 in an insertion-removal direction 50, while the ink cartridge 30 is in an upright position, as shown in FIG. 3A, with a top face of the ink cartridge 30 facing upward and a bottom face of the ink cartridge 30 facing downward. In this embodiment, the insertion-removal direction 50 extends in a horizontal direction. The insertion direction 56 is an example of the insertion-removal direction 50. The removal direction 55 is an example of the insertion-removal direction 50. The insertion direction 56 and the removal direction 55 are opposite directions. In another embodiment, the insertion-removal direction 50 may not extend exactly in a horizontal direction but may extend in a direction intersecting a horizontal direction and the vertical direction.

The frame 31 has substantially a rectangular parallelepiped shape, and its dimension in a width direction (left-right direction) 51 is less than each of its dimension in a height direction (up-down direction) 52 and its dimension in a depth direction (front-rear direction) 53. The width direction 51, the height direction 52, and the depth direction 53 are perpendicular to each other. The width direction 51 extends in a horizontal direction. The depth direction 53 extends in a horizontal direction. The height direction 52 extends in the vertical direction. The insertion-removal direction 50 is parallel with the depth direction 53. The frame 31 comprises a front wall 40, a rear wall 41, a top wall 39, a bottom wall 42, and a right wall 38. The front wall 40 and the rear wall 41 at least partly overlap when viewed in the depth direction 53. The top wall 39 and the bottom wall 42 at least partly overlap when viewed in the height direction 52. The right wall 38 is positioned on one side of the frame 31 with respect to the width direction 51. In this embodiment, the right wall 38 is positioned on the right side of the frame 31 when the frame 31 is viewed from the front-wall 40 side. When the ink cartridge 30 is inserted into the cartridge mounting portion 110, the front wall 40 is positioned at the front side of the ink cartridge 30, and the rear wall 41 is positioned at the rear side of the ink cartridge 30. When the ink cartridge 30 is inserted into the cartridge mounting portion 110, the front wall 40 is oriented toward the insertion direction 56, and the rear wall 41 is oriented toward the removal direction 55. The rear wall 41 is positioned away from the front wall 40 in the removal direction 55. The frame 31 comprises a front outer face, a rear outer face, a top outer face, a bottom outer face, and a right outer face. The front wall 40 comprises the front outer face, the rear wall 41 comprises the rear outer face, the top wall 39 comprises the top outer face, the bottom wall 42 comprises the bottom outer face, and the right wall 38 comprises the right outer face.

The top wall 39 is connected to the upper end of the front wall 40, the upper end of the rear wall 41, and the upper end of the right wall 38. The bottom wall 42 is connected to the lower end of the front wall 40, the lower end of the rear wall 41, and the lower end of the right wall 38. The right wall 38 is connected to the right end of the front wall 40, the right end of the rear wall 41, the right end of the top wall 39, and the right end of the bottom wall 42. The other side of the frame 31 with respect to the width direction 51 is opened. In this embodiment, the left side of the frame 31, which is positioned on the left side of the frame 32 when the frame 31 is viewed from the front-wall 40 side, is opened. Each wall of the frame 31 allows the light emitted from the light emitting portion 104 of the sensor 103 to pass therethrough.

The ink cartridge 30 comprises a left wall 37 connected to the left side of the frame 31 with respect to the width direction 51. In this embodiment, the left wall 37 is a film 44. The film 44 and the frame 31 have almost the same outer contour when viewed in the width direction 51. The film 44 is welded to the left end of the front wall 40, the left end of the rear wall 41, the left end of the top wall 39, and the left end of the bottom wall 42, 45 by heat. As such, it is possible to store ink in the ink chamber 36 defined by the front wall 40, the rear wall 41, the top wall 39, the bottom wall 42, the right wall 38, and the left wall 37 (the film 44). The left wall 37 (the film 44) allows the light emitted from the light emitting portion 104 of the sensor 103 to pass therethrough. The ink cartridge 30 may comprise a cover covering the film 44 from outside. In such a case, the cover also allows the light emitted from the light emitting portion 104 of the sensor 103 to pass therethrough.

[Ink Chamber 36]

Before the ink cartridge 30 is mounted to the cartridge mounting portion 110, the ink chamber 36 stores ink therein, and the inside of the ink chamber 36 is depressurized to be a pressure less than the atmospheric pressure outside the ink cartridge 30. When the ink cartridge 30 is mounted to the cartridge mounting portion 110, the ink chamber 36 is brought into communication with the atmosphere of the outside of the ink cartridge 36 via the air communication portion 70. When the ink cartridge 30 is mounted to the cartridge mounting portion 110, the ink stored in the ink chamber 36 flows out of the ink chamber 36 via the ink supply portion 60.

In this embodiment, the ink stored in the ink chamber 36 blocks the light emitted from the light emitting portion 104 of the sensor 103. More specifically, when a body of ink is in the detection position and the light emitted by the light emitting portion 104 of the sensor 103 reaches one side of the body of ink in a direction (the width direction 51) perpendicular to the insertion-removal direction 50, an amount (intensity) of light coming out of the other side of the body of ink and reaching the light receiving portion 105 of the sensor 103 is less than a predetermined amount (intensity), e.g., zero. The blocking of the light is caused by the body of ink completely preventing the light from passing therethrough in width direction 51 perpendicular to the insertion-removal direction 50, by the body of ink absorbing some amount of the light, by the body of ink scattering the light, or by another phenomenon. On the other hand, when the body of ink is not in the detection position and the light emitted by the light emitting portion 104 of the sensor 103 reaches one side of the ink cartridge 30 in the width direction 51 perpendicular to the insertion-removal direction 50, an amount (intensity) of light coming out of the other side of the ink cartridge 30 and reaching the light receiving portion 105 of the sensor 103 is greater than or equal to the predetermined amount (intensity). As such, the amount (intensity) of the light reaching the light receiving portion 105 of the sensor 103 depends on whether the body of ink is in the detection position or not.

[Ink Supply Portion 60]

Referring to FIGS. 1, 3A and 3B, the ink supply portion 60 is positioned adjacent to the boundary between the inner face of the front wall 40 and the inner face of the bottom wall 42. The ink supply portion 60 is positioned at a lower portion of the ink cartridge 30 when the ink cartridge 30 is in the upright position. The ink supply portion 60 is aligned with the ink chamber 36 in the depth direction 53. The ink supply portion 60 comprises a liquid supply chamber, e.g., an ink supply chamber 61 having an opening 62 and an opening 63. The ink supply chamber 61 can be in fluid communication with the outside of the ink cartridge 30 through the opening 62 and the ink supply chamber 61 is in fluid communication with the ink chamber 36 through the opening 63. Before the ink cartridge 30 is mounted to the cartridge mounting portion 110, the ink supply chamber 61 is filled with ink, and the inside of the ink supply chamber 61 is depressurized to have a pressure, e.g., the same pressure as in the ink chamber 36, which is less than the atmospheric pressure outside the ink cartridge 30. The front wall 40 defines one end of the ink supply chamber 61 in the insertion-removal direction 50, i.e., the front end of the ink supply chamber 61. The opening 62 is formed through the front wall 40 in the insertion-removal direction 50. The opening 63 is formed through a wall of the frame 31 in the insertion-removal direction 50, which wall defines the other end of the ink supply chamber 61 in the insertion-removal direction 50, i.e., the rear end of the ink supply chamber 61. The wall surface defining the upper end of the opening 63 is slanted and extends upward and rearward, i.e., extends upward and toward the ink chamber 36.

Figure 5:
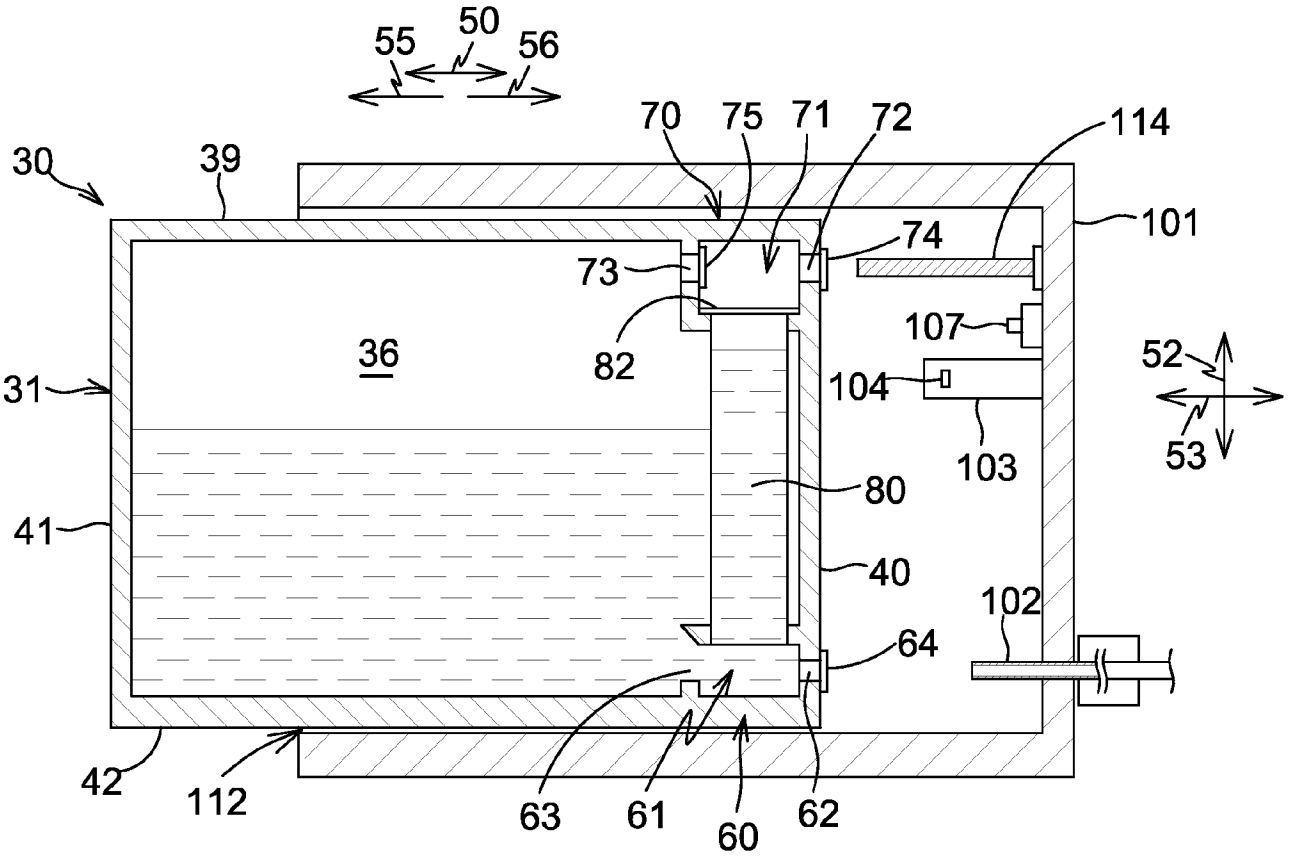
FIG. 5 is a cross-sectional view of the ink cartridge and the cartridge mounting portion, in which the ink cartridge does not contact a rod of the cartridge mounting portion.

Referring to FIG. 5, the ink cartridge 30 comprises a closing member, e.g., a rubber plug 64, attached to the front wall 40 and closing the opening 62. The rubber plug 64 has a slit formed therethrough in the insertion-removal direction 50, through which the hollow tube 102 can pass. Before the hollow tube 102 enters the slit of the rubber plug 64, the slit is closed by the elasticity of the rubber plug 64. Furthermore, the ink cartridge 30 may comprise an additional closing member, e.g., a film (not shown) attached to the rubber plug 64 to cover the slit. The communication between the ink supply chamber 61 and the outside of the ink cartridge 30 is blocked by the rubber plug 64 with the closing slit and the film. When the ink cartridge 30 is mounted to the cartridge mounting portion 110, the hollow tube 102 contacts the film, and then ruptures the film. The ruptured portion of the film moves to form an opening in the film through which the hollow tube 102 is inserted. In other words, a portion of the film is moved by the hollow tube 102. Subsequently, the hollow tube 102 then enters the slit of the rubber plug 64. The hollow tube 102 moves, i.e., pushes the portion of the rubber plug 64 surrounding the slit and widens the slit. As a result, the hollow tube 102 penetrates through the rubber plug 64 while the rubber plug 64 elastically contacting the outer surface of the hollow tube 102. Ink stored in the ink cartridge 30 is allowed to flow into the ink tube 20 via the hollow tube 102. When the hollow tube 102 is removed from the rubber plug 64, the slit is again closed by the elasticity of the rubber plug 64.

[Air Communication Portion 70]

Referring to FIGS. 1, 3A and 3B, the air communication portion 70 is positioned adjacent to the boundary between the inner face of the front wall 40 and the inner face of the top wall 39. The air communication portion 70 is positioned at an upper portion of the ink cartridge 30 when the ink cartridge 30 is in the upright position. The air communication portion 70 is aligned with the ink chamber 36 in the depth direction 53. The air communication portion 70 comprises an air communication chamber 71 having an opening 72 and an opening 73. The air communication chamber 71 can be in fluid communication with the outside of the ink cartridge 30 through the opening 72 and the air communication chamber 71 can be in fluid communication with the ink chamber 36 through the opening 73. Before the ink cartridge 30 is mounted to the cartridge mounting portion, the inside of the air communication chamber 71 is depressurized to have a pressure, e.g., the same pressure as in the ink chamber 36, which is less than the atmospheric pressure outside the ink cartridge 30. The front wall 40 defines one end of the air communication chamber 71 in the insertion-removal direction 50, i.e., the front end of the air communication chamber 71. The opening 72 is formed through the front wall in the insertion-removal direction 50. The opening 73 is formed through a wall of the frame 31 in the insertion-removal direction 50, which wall defines the other end of the air communication chamber 71 in the insertion-removal direction 50, i.e., the rear end of the air communication chamber 71.

Referring to FIG. 5, the ink cartridge 30 comprises a closing member, e.g., a film 74, attached to the front wall 40. Before the ink cartridge 30 is mounted to the cartridge mounting portion 110, the opening 72 is closed by the film 74. The rod 114 is configured to contact the film 74 when the ink cartridge 30 is mounted to the cartridge mounting portion 110. The rod 114 then ruptures the film 74. The ruptured portion of the film 74 moves to form an opening in the film 74 through which the rod 114 is inserted. In other words, a portion of the film 74 is moved by the rod 114. When the rod 114 is inserted through the film 74 and the opening 72, the air communication chamber 71 is brought into communication with the atmosphere outside the ink cartridge 30 through the opening 72.

Referring to FIG. 5, the ink cartridge 30 comprises a closing member, e.g., a film 75, attached to the wall having the opening 73 formed therethrough. Before the ink cartridge 30 is mounted to the cartridge mounting portion 110, the opening 73 is closed by the film 75. The rod 114 is configured to contact the film 75 when the ink cartridge 30 is mounted to the cartridge mounting portion 110. The rod 114 then ruptures the film 75. The ruptured portion of the film 75 moves to form an opening in the film 75 through which the rod 114 is inserted. In other words, a portion of the film 75 is moved by the rod 114. When the rod 114 is inserted through the film 75 and the opening 73, the ink chamber 36 is brought into communication with the atmosphere outside the ink cartridge 30 through the opening 73, the air communication chamber 71, and the opening 72.

[Capillary Portion 80]

Referring to FIGS. 3B, 3C and 5, The ink cartridge 30 comprises a capillary portion 80 in the frame 31. The lower end of the capillary portion 80 is connected to the ink supply chamber 61 between the opening 62 and the opening 63. The lower end of the capillary portion 80 is at a wall surface defining the upper end of the ink supply chamber 71. The upper end of the capillary portion 80 is connected to the air communication chamber 71 between the opening 72 and the opening 73. The capillary portion 80 extends in the height direction 52. Before the ink cartridge 30 is mounted to the cartridge mounting portion 110, the capillary portion 80 is at least partly filled with ink, and the inside of the capillary portion 80 is depressurized to have a pressure, e.g., the same pressure as in the ink chamber 36, which is less than the atmospheric pressure outside the ink cartridge 30.

Referring to FIG. 3C, the capillary portion 80 comprises a plurality of capillary tubes, or capillaries 81 bundled together. In FIGS. 1 and 5-8, the depiction of the capillaries 81 is omitted. In this embodiment, each of the capillaries 81 extends straight in the height direction 52. The cross-sectional area of each of the capillaries 81 along a plane parallel with the width direction 51 and the depth direction 53 is small enough for ink to move from the lower end of the capillary portion 80 toward the upper end of the capillary portion 80 by capillary force. The capillary portion 80 has a cross section along a plane parallel with the width direction 51 and the depth direction 53, i.e., along a horizontal plane. The dimension of the cross section in the depth direction 53 is greater than the dimension of the cross section in the width direction 51. In this embodiment, the cross section has an elliptical shape. The cross-sectional area of the capillary portion 80 along a plane perpendicular to the width direction 51 is greater than the cross sectional area of the capillary portion 80 along a plane perpendicular to the depth direction 53. The spatial size of the capillary portion 80 is less than the spatial size of the ink chamber 36, and the capacity of the capillary portion 80 is less than the capacity of the ink chamber 36.

The ink cartridge 30 comprises an air permeable film 82 at the upper end of the capillary portion 80. The air permeable film 75 allows air to pass therethrough, but blocks liquid from passing therethrough. The air permeable film 75 is a porous film and is made of polytetrafluoroethylene, polychlorotrifluoroethylene, tetrafluoroethylene-hexafluoropropylene copolymer, tetrafluoroethylene-perfluoroalkyl vinly ether copolymer, tetrafluoroethylene-ethylene copolymer or another known material.

[Controller 130]

Figure 4:
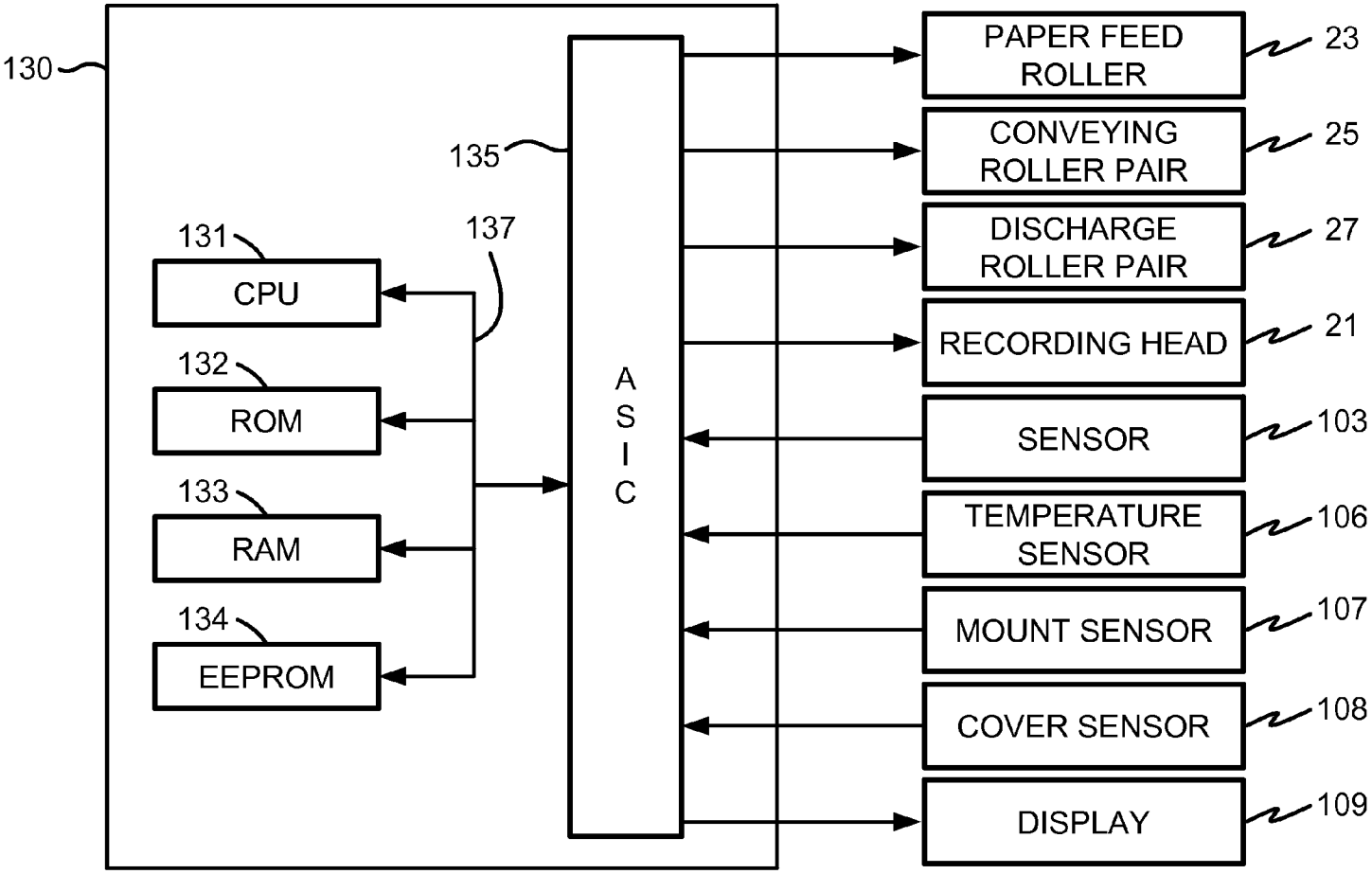
FIG. 4 is a functional block diagram of the printer.

Referring to FIG. 4, the printer 10 comprises a controller 130. The controller 130 comprises a CPU 131, a ROM 132, a RAM 133, an EEPROM 134, and an ASIC 135, which are connected to each other by an internal bus 137. The ROM 132 stores programs for the CPU 131 to control various operations of the printer 10. The RAM 133 is used as a storage area for temporarily store date and signals for the CPU 131 to use in executing the programs and as a working area for date processing. The EEPROM 134 stores settings and flags which may be retained even after the power is off. One chip may comprise the CPU 131, the ROM 132, the RAM 133, the EEPROM 134, and the ASIC 135, or one chip may comprise some of the CPU 131, the ROM 132, the RAM 133, the EEPROM 134, and the ASIC 135, and another chip may comprise the other of the CPU 131, the ROM 132, the RAM 133, the EEPROM 134, and the ASIC 135.

The controller 130 is configured to rotate the paper feed roller 23, the conveying roller pair 25, and the discharge roller pair 27 by driving a motor (not shown). The controller 130 is configured to control the recording head 21 to eject ink from the nozzles 29. More specifically, the controller 130 is configured to send to the head control board 21A control signals indicating the values of driving voltages to be applied to the piezoelectric actuators 29A. The head control board 21A is configured to apply the driving voltages to the piezoelectric actuators 29A based on the control signals received from the controller 130, such that ink is ejected from the nozzles 29. The printer 10 also comprises a display 109, and the controller 130 is configured to control the display 109 to display information about the printer 10 and the ink cartridge 30 or a variety of messages.

The printer 10 also comprises a temperature sensor 106 and a cover sensor 108, and the controller 130 is configured to receive the detection signals output from the sensor 103, signals output from the temperature sensor 106, the detection signals output from the mount sensor 107, and signals output from the cover sensor 108. The temperature sensor 106 is configured to output signals based on temperature. Where the temperature sensor 106 senses temperature is not limited to a specific position. The temperature sensor 103 may be positioned in the cartridge mounting portion 110, or may be positioned on an outer surface of the printer 10. The cover sensor 108 is configured to output different signals based on whether the cover for the opening 112 of the cartridge mounting portion 110 is opened or closed The ink cartridge 30 is inserted into the cartridge mounting portion 110 when the cover of the cartridge mounting portion 110 is opened. Referring to FIG. 5, when the ink cartridge 30 is being inserted into the cartridge mounting portion 110 and has not contacted the rod 114 yet, the opening 64 is closed by the rubber plug 64, the opening 72 is closed by the film 74, and the opening 73 is closed by the film 75. The opening 63 is not closed. The ink chamber 36 stores ink, the ink supply chamber 61 is filled with ink, and the capillary portion 80 is at least partially filled with ink. The ink chamber 36, the ink supply portion 61, the capillary portion 80, and the air communication chamber 71 are depressurized to have a pressure less than the atmospheric pressure outside the ink cartridge 30. The sensor 103 outputs the High-level signal to the controller 130, and the mount sensor 107 outputs the Low-level signal to the controller 130.

Figure 6:
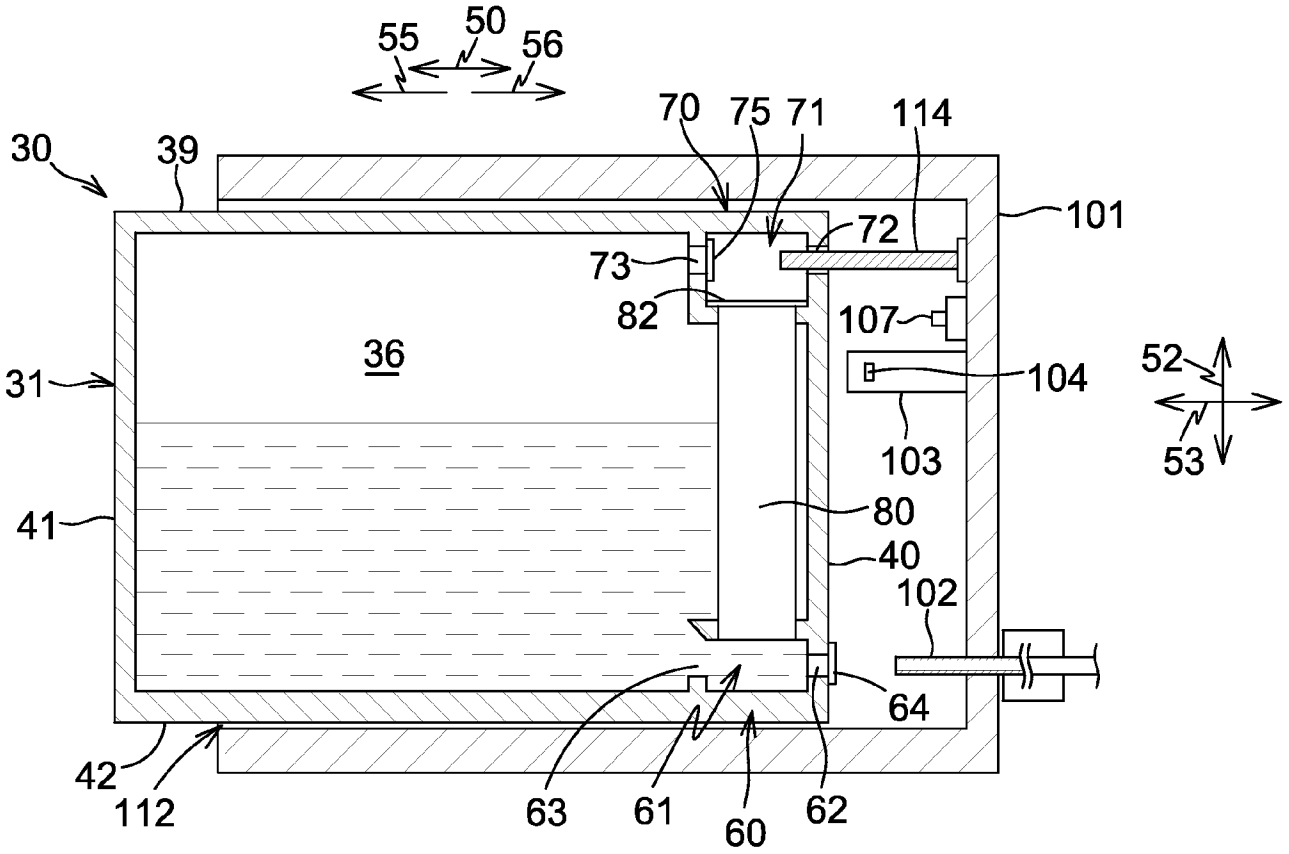
FIG. 6 is a cross-sectional view of the ink cartridge and the cartridge mounting portion, in which the rod penetrates through a film of the ink cartridge but does not reach another film of the ink cartridge.

Referring to FIG. 6, when the ink cartridge 30 is further inserted into the cartridge mounting portion 110, the rod 114 penetrates and ruptures the film 74 and enters the air communication chamber 71. When this occurs, the air communication chamber 71 is brought into communication with the atmosphere outside of the ink cartridge 30 through the opening 72. That is, the upper end of the capillary portion 80 is brought into communication with the atmosphere before the ink chamber 36 is brought into communication with the atmosphere. As a result, due to the pressure differential between the atmospheric pressure and the internal pressure of the ink chamber 36, ink in the capillary portion 80 moves out of the capillary portion 80 to the ink chamber 36 via the ink supply chamber 61. The ink surface in the capillary portion 80 falls below the detection position. The hollow tube 102 does not contact the rubber plug 64 and the film attached to the rubber plug 64.

When the pressure differential between the atmospheric pressure and the internal pressure of the ink chamber 36 is greater than a certain value, the ink surface in the capillary portion 80 moves down to the lower end of the capillary portion 80. When the pressure differential between the atmospheric pressure and the internal pressure of the ink chamber 36 is large enough, air which was introduced from the opening 72 into the air communication chamber 71 reaches the ink supply chamber 61 through the capillary portion 80. The air in the ink supply chamber 61 moves toward the air layer in the upper portion of the ink chamber 36 along the ceiling of the ink supply chamber 61 and the slanted wall surface defining the upper portion of the opening 63 as air bubbles. Accordingly, even if the initial amount of liquid filling the capillary portion 80 varies from one ink cartridge 30 to another, by setting the inner pressure of the ink chamber 36 to be less than a predetermined pressure, the ink surface in the capillary portion 80 moves down to the lower end of the capillary portion 80 when the air communication chamber 71 is brought into communication with the atmosphere.

Figure 7:
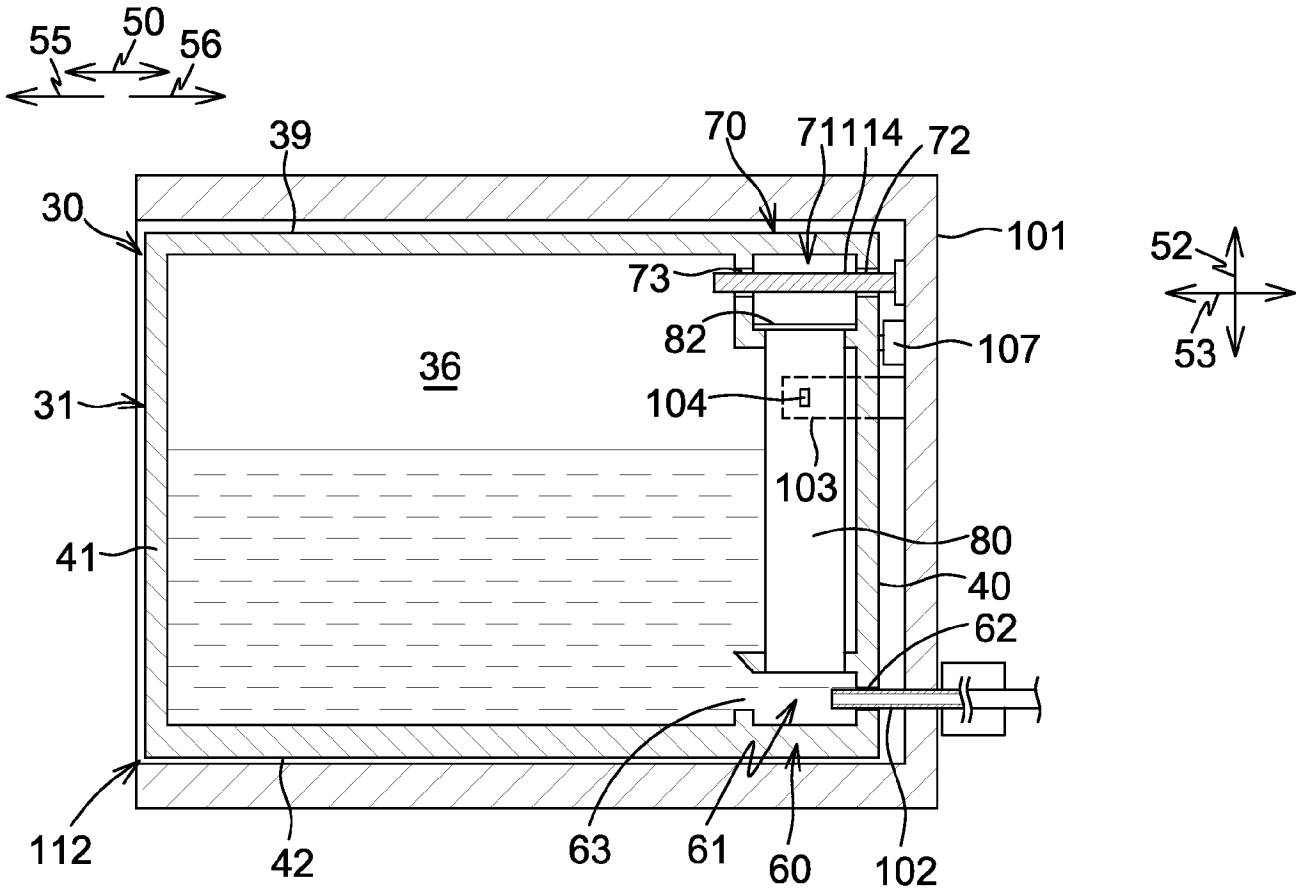
FIG. 7 is a cross-sectional view of the ink cartridge and the cartridge mounting portion when mounting of the ink cartridge to the cartridge mounting portion has been just completed.
Figure 8:
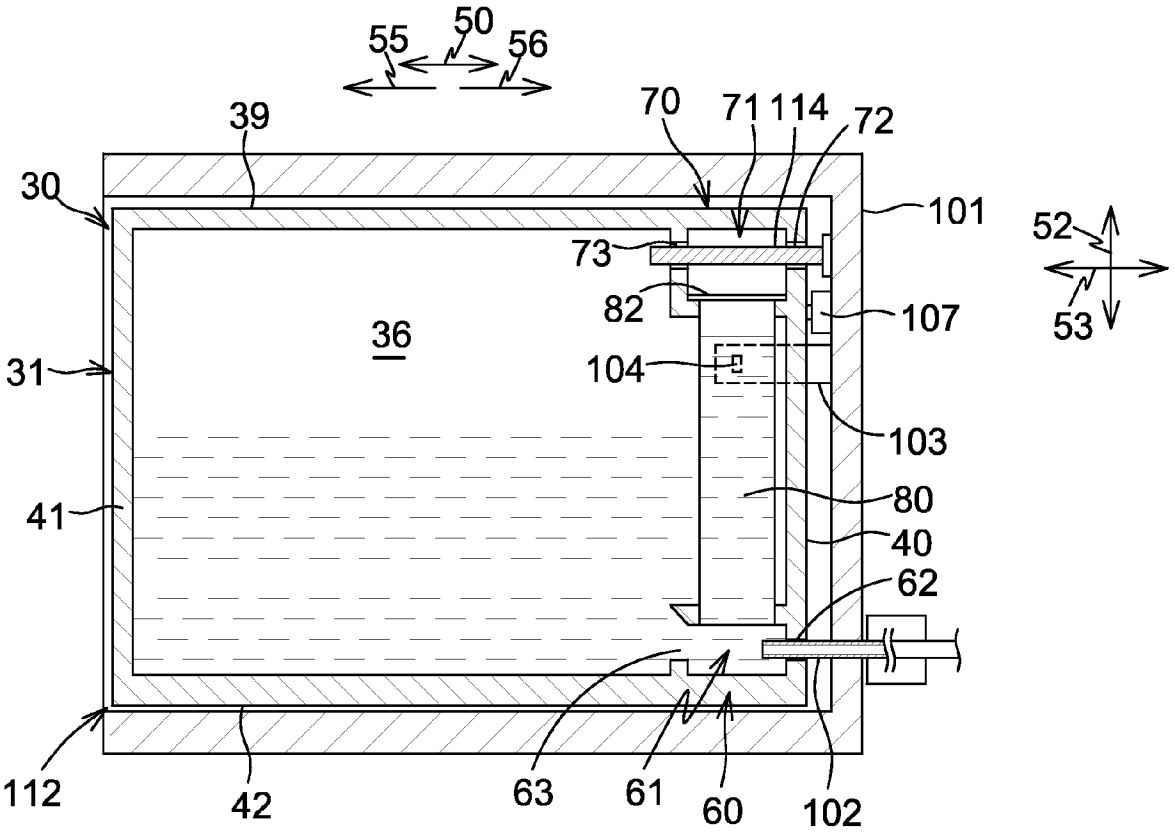
FIG. 8 is a cross-sectional view of the ink cartridge and the cartridge mounting portion when mounting of the ink cartridge to the cartridge mounting portion has been completed and the ink surface in the capillary portion has reached a detection position.

Referring to FIG. 7, when the ink cartridge 30 is further inserted and thereby the mounting of the ink cartridge 30 to the cartridge mounting portion 100 is completed, the rod 114 penetrates and ruptures the film 75 and enters the ink chamber 36. When this occurs, the ink chamber 36 is brought into communication with the atmosphere outside of the ink cartridge 30 through the opening 73, the air communication chamber 71, and the opening 72. That is, with the rod 114, the air communication chamber 71, the capillary portion 80, ink supply chamber 61, and the ink chamber 36 are brought into communication with the atmosphere in this order. At the same time, the hollow tube 102 penetrates and ruptures the film attached to the rubber plug 64 and then penetrates though the rubber plug 64 to enter the ink supply chamber 61. When this occurs, ink stored in the ink chamber 36 flows out of the ink chamber 36 and flows into the hollow tube 102 via the ink supply chamber 61. The ink also flows into the capillary portion 80 and moves up from the lower end of the capillary portion 80 to the upper end of the capillary portion 80.

When the mounting of the ink cartridge 30 to the cartridge mounting portion 110 is completed, the front wall 40 of the ink cartridge 30 pushes the mount sensor 107. When this occurs, the mount sensor 107 outputs the High-level signal to the controller 130. The ink surface in the capillary portion 80 has not reached the height of the sensor 103, i.e., has not reached the detection position at a time immediately after the mounting of the ink cartridge 30 to the cartridge mounting portion 110 is completed. Therefore, in the state depicted in FIG. 7, the sensor 103 outputs the High-level signal to the controller 130. Subsequently, the ink surface in the capillary portion 80 moves up, and referring to FIG. 8, when the ink surface in the capillary portion 80 reaches the detection position, the sensor 103 outputs the Low-level signal to the controller 130. In other words, the sensor 103 outputs the detection signal based on the presence or absence of ink in the detection position in the capillary portion 80.

When a user thinks that the mounting of the ink cartridge 30 to the cartridge mounting portion 110 has been completed, the user closes the cover of the cartridge mounting portion 110 to cover the opening 112. Even if the mounting of the ink cartridge 30 to the cartridge mounting portion 110 has not been completed, the closed cover contacts and pushes the ink cartridge 30 in the insertion direction 56 to complete the mounting of the ink cartridge 30 to the cartridge mounting portion 110.

[Processes Performed by the Controller 130]

Figure 9:
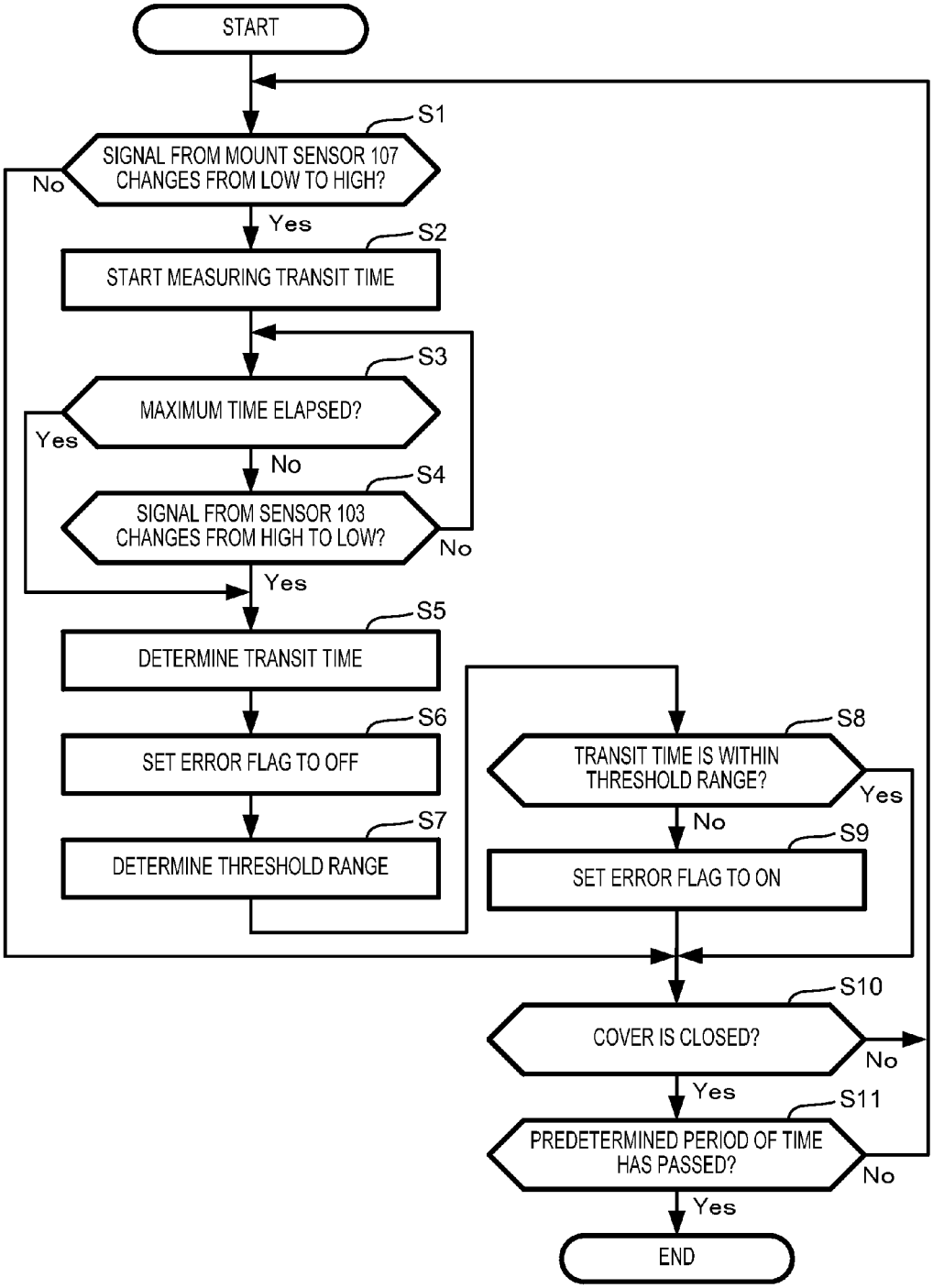
FIG. 9 is a flow chart of processes performed by a controller when a cover of the cartridge mounting portion is opened and a mount sensor outputs a Low-level signal.

The controller 130 is configured to perform the processes of FIG. 9 when the controller 130 receives the signal from the cover sensor 108 indicating that the cover of the cartridge mounting portion 110 is opened and receives the Low-level signal from the mount sensor 107. In other words, the processes of FIG. 9 start when the cover of the cartridge mounting portion 110 is opened and the ink cartridge 30 is removed. When the cartridge 30 is not mounted to the cartridge mounting portion 110 before the cover of the cartridge mounting portion 110 is opened, the processes of FIG. 9 start when the cover of the cartridge mounting portion 110 is opened.

The controller 130 starts measuring a transit time at step S2 if the detection signal output from the mount sensor 107 changes from the Low-level signal to the High-level signal (step S1: Yes). If the detection signal output from the mount sensor 107 does not change from the Low-level signal to the High-level signal (step S1: No), the controller 130 performs the process of step S10 (described later). For instance, the situation in which the detection signal output from the mount sensor 107 does not change from the Low-level signal to the High-level signal (step S1: No) corresponds to a situation in which a new ink cartridge 30 has not been mounted to the cartridge mounting portion 110.

Subsequently, the controller 130 determines whether the elapsed time since the controller 130 starts measuring the transit time has exceeded a predetermined maximum time at step S3. If the elapsed time has exceeded the maximum time (step S3: Yes), the controller 130 performs the process of step S5 (described later). If the elapsed time has not exceeded the maximum time (step S3: No), the controller 130 determines whether the detection signal output from the sensor 103 changes from the High-level signal to the Low-level signal at step S4. If the detection signal output from the sensor 103 does not change from the High-level signal to the Low-level signal (step S4: No), the controller 103 performs the process of step S3 again. If the detection signal output from the sensor 103 changes from the High-level signal to the Low-level signal (step S4: Yes), the controller 103 determines the transit time at step S5.

The transit time is a period of time from when the detection signal output from the mount sensor 107 changes from the Low-level signal to the High-level signal (step S1: Yes) to when the detection signal output from the sensor 103 changes from the High-level signal to the Low-level signal (step S4: Yes). In other words, the transit time is a period of time from when the ink chamber 36 is brought into communication with the atmosphere to when ink in the capillary portion 80 reaches the detection position. In further other words, the transit time is a period of time for ink to move from the lower end of the capillary portion 80 to the upper end of the capillary portion 80. If the elapsed time has exceeded the maximum time (step S3: Yes), the controller 130 considers the maximum time as the transit time.

The situation in which the elapsed time has exceeded the maximum time (step S3: Yes) corresponds to a situation in which ink flows very slowly from the ink chamber 36 to the capillary portion 80 via the ink supply chamber 61 or does not flow from the ink chamber 36 to the capillary portion 80. A reason for the slow movement of ink may be that the viscosity of ink stored in the ink chamber 36 has become high.

The timing when the ink chamber 36 is brought into communication with the atmosphere and the timing when the output signal from the mount sensor 107 changes from the Low-level signal to the High-level signal are the same or close. Therefore, the latter timing is presumed as the former timing. The controller 130 measures, as the transit time, a time from when the detection signal output from the mount sensor 107 changes from the Low-level signal to the High-level signal to when the detection signal output from the sensor 103 changes from the High-level signal to the Low-level signal. The transit time is an example of a physical quantity, based on which the velocity of ink moving in the capillary portion 80 can be specified.

Subsequently, the controller 130 resets an error flag, i.e., sets the error flag to "OFF" at step S6. The error flag is set to "ON" when the transit time is not within a threshold range (step S8: No). The error flag is set for each ink cartridge 30. The controller 130 stores the error flag in the EEPROM 134.

Subsequently, the controller 130 determines the threshold range based on the signal output from the temperature sensor 106 at step S7. The threshold range is compared with the transit time for estimating the viscosity of ink stored in the ink chamber 36. If the signal output from the temperature sensor 106 indicates that the temperature is relatively high, the controller 130 sets at least one of the upper limit value and the lower limit value of the threshold range lower. In other words, if the signal output from the temperature sensor 106 indicates that the temperature is relatively low, the controller 130 sets at least one of the upper limit value and the lower limit value of the threshold range higher.

Subsequently, the controller 130 compares the transit time determined at step S5 with the threshold range determined at step S7 and determines whether or not the transit time is within the threshold range at step S8. If the transit time is below the lower limit value, it is estimated that the viscosity of ink is too low. If the transit time is above the upper limit value, it is estimated that the viscosity of ink is too high. If the transit time is out of the threshold range (step S8: No), the controller 130 sets the error flag to "ON" at step S9. If the transit time is within the threshold range (step S8: Yes), the controller 130 skips the process of step S9.

Subsequently, the controller 130 determines whether or not the cover sensor 108 outputs the signal indicating that the cover of the cartridge mounting portion 110 is closed at step S10. If it is determined that the cover is open (step S10: No), the controller 130 repeats the process of step S1 and the processes that follow step S1. If it is determined that the cover is closed (step S10: Yes), the controller 130 determines at step S11 whether or not a predetermined period of time has passed since it is determined that the cover is closed at step S10.

If the predetermined period of time has passed (step S11: Yes), the controller 130 completes the processes of FIG. 9. If the predetermined period of time has not passed (step S11: No), the controller 130 repeats the process of step S1 and the processes that follow step S1. If the controller 130 determines that the cover of the cartridge mounting portion 110 is open (step S10: No) when the controller 130 is repeating the process of step S1 and the processes that follow step S1, the controller 130 cancels the counting of time it started when it determined that the cover was closed (step S10: Yes).

Figure 10:
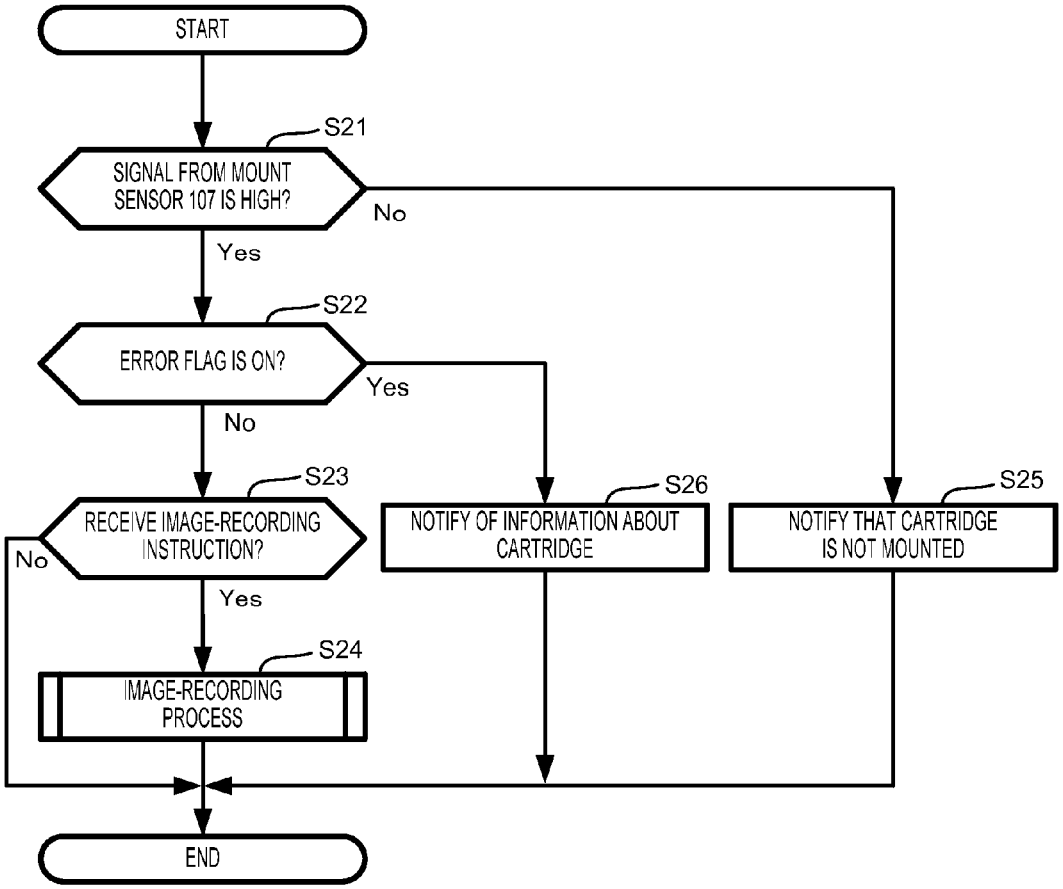
FIG. 10 is a flow chart of processes performed by the controller when the processes of FIG. 9 have been completed and the cover of the cartridge mounting portion is closed.

After completing the processes of FIG. 9, the controller 130 performs the processes of FIG. 10 repeatedly at a predetermined interval when the controller 130 receives from the cover sensor 108 the signal indicating that the cover of the cartridge mounting portion 110 is closed.

The controller 130 determines whether the mount sensor 107 outputs the High-level signal at step S21. If the mount sensor 107 outputs the Low-level signal (step S21: No), the controller 130 notifies a user that the ink cartridge 30 is not mounted at step S25, and completes the processes of FIG. 10. How to notify a user is not limited to a specific way, but the controller 130 may have the display 109 display a message or have a speaker (not shown) of the printer 10 sound out an audio message.

If the mount sensor 107 outputs the High-level signal (step S21: Yes), the controller 130 determines whether the error flag is set to "ON" at step S22. If the error flag is set to "ON" (step S22: Yes), the controller 130 performs the process of step S26. The controller 130 notifies a user of information about the ink cartridge 30 at step S26, and then completes the process of FIG. 10. The controller 130 may notify a user that ink in the ink chamber 36 has deteriorated, or that the replacement of the ink cartridge 30 is needed. How to notify a user is not limited to a specific way, but the controller 130 may have the display 109 display a message or have a speaker (not shown) of the printer 10 sound out an audio message.

If the error flag is set to "OFF" (step S22: No), the controller 130 determines whether it receives an image-recording instruction at step S23. If the controller 130 does not receive the image-recording instruction (step S23: No), the controller 130 completes the processes of FIG. 10. If the controller 130 receives the image-recording instruction (step S23: Yes), the controller 130 directly or indirectly controls the recording head 21, the paper feed roller 23, the conveying roller pair 25, the discharge roller pair 27, etc. to record an image of a sheet of recording paper at step S24, and then complete the processes of FIG. 10. The controller 130 may record an image on one sheet of recording paper when performing the process of step S24 once, or the controller 130 may record images corresponding to all the image date that the controller 130 received when performing the process of step S24 once.

If the error flag is set to "ON" (step S22: Yes), the controller 130 does not perform the process of step S24, i.e., the image-recording process. In other words, the controller 130 skips step S24 and thereby restricts the consumption of ink by the recording head 21.

According to the processes of FIG. 9, if an ink cartridge 30 having a sufficient amount of ink stored therein is removed from the cartridge mounting portion 110, and then is mounted to the cartridge mounting portion 110 again, the error flag is set to "ON." This is because ink no longer moves from the lower end of the capillary portion 80 to the upper end of the capillary portion 80 when the ink cartridge 30 is mounted to the cartridge mounting portion 110 again. In this situation, the image-recording process of step S24 is skipped even if the ink cartridge 30 has a sufficient amount of ink. Therefore, in another embodiment, the controller 130 may ask a user if he or she has replaced the ink cartridge 30 after step S22. How to ask a user is not limited to a specific way, but the controller 130 may have the display 109 display a message or have a speaker (not shown) sound out an audio message. The controller 130 then may wait for a signal to come from an input interface (not shown) of the printer 10. For instance, the input interface is an interface on which a user may give instructions to the printer 10 by pressing bottoms on it. If the controller 130 receives from the input interface a signal indicating that the ink cartridge 30 has not been replaced, the controller 130 may not perform the process of step S26 and perform the process of step S24. In such a case, the processes performed by the controller 130 may be different from the ones of FIGS. 9 and 10, but the description thereof is omitted here.

Advantages

According to the above-described embodiment, the velocity of ink moving in the capillary portion 80 varies depending on the viscosity of ink. By measuring the transit time required for ink to move from the lower end of the capillary portion 80 to the upper end of the capillary portion 80, the viscosity of ink in the ink chamber 36 can be estimated, e.g. whether the viscosity of ink is within a certain range or not can be estimated. As such, the degree of deterioration of ink can be estimated by calculating the transit time even when the ink cartridge 30 has not been mounted to the printer 10 and been unused for a long time. Moreover, if a plurality of ink cartridges 30 storing inks having different viscosities are configured to be mounted to the same cartridge mounting portion 110, it is possible to determine which ink cartridge 30 is mounted by calculating the transit time.

If ink flows from the ink chamber 36 to the capillary portion 80 due to head differential between the ink surface in the ink chamber 36 and the ink surface in the capillary portion 80 only, ink stops moving when the height of the ink surface in the ink chamber 36 and the height of the ink surface in the capillary portion 80 becomes the same. Nevertheless, in this embodiment, in addition to the head differential, capillary force causes ink to move in the capillary portion 80. Therefore, referring to FIG. 8, the ink surface in the capillary portion 80 exceeds the ink surface in the ink chamber 36. That is, the ink surface in the capillary portion 80 moves up to a position higher than the ink surface in the ink chamber 36. Therefore, the sensor 103 can be provided at a position above the ink surface in the ink chamber 36. Even if ink should leak from the ink cartridge 30, it is difficult for the ink to reach the sensor 103, and therefore the sensor 103 may not be damaged by ink contamination.

In the above-described embodiment, the capillary portion 80, e.g., each of the capillaries 81, extends in the height direction 52 (the vertical direction). Nevertheless, in another embodiment, the capillary portion 80, e.g., each of the capillaries 81, may extend in a direction intersecting the height direction 52 (the vertical direction). Moreover, in another embodiment, an end of the capillary portion 80 connected to the air communication chamber 71 may be positioned below an end of the capillary portion 80 connected to the ink supply chamber 61. Accordingly, the position of the sensor 103 is not limited to a specific position. There is more flexibility in designing the cartridge mounting portion 110 with respect to the position of the sensor 103.

In the above-described embodiment, the pressure in the ink cartridge 30 is less than the atmospheric pressure before the ink cartridge 30 is mounted to the cartridge mounting portion 110, and the air communication chamber 71 is brought into communication with the atmosphere before the ink chamber 36 is brought into communication with the atmosphere. Therefore, at the timing when the air communication chamber 71 is brought into communication with the atmosphere, ink in the capillary portion 80 is pulled into the ink chamber 36. The ink surface in the capillary portion 80 then falls below the detection position, and reaches the lower end of the capillary portion 80. Subsequently, at the timing when the ink chamber 36 is brought into communication with the atmosphere, ink enters the capillary portion 80 again and the ink surface in the capillary portion 80 reaches the detection position. Because the ink chamber 36 and the capillary portion 80 are always in communication with each other via the ink supply chamber 61, the amount of ink in the capillary portion 80 before the ink cartridge 30 is mounted to the cartridge mounting portion 110 varies from one ink cartridge 30 to another. Nevertheless, as described above, because the ink surface in the capillary portion 80 moves down to the lower end of the capillary portion 80 before the ink surface moves up in the capillary portion 80, the position of the ink surface when the controller 130 starts measuring the transit time can be set to a certain staring position. Therefore, the transit time does not depend on how much amount of ink is in the capillary portion 80 before the ink cartridge 30 is mounted to the cartridge mounting portion 110.

In the above-described embodiment, the ink surface in the capillary portion 80 is detected by the sensor 103. In another embodiment, the ink surface in the ink chamber 36 may be detected by the sensor 103. In such a case, the sensor 103 is positioned below the initial ink surface in the ink chamber 36 before the ink chamber 36 is brought into communication with the atmosphere. The controller 130 measures, as the transit time, a time from when the detection signal from the mount sensor 107 changes from the Low-level signal to the High-level signal to when the detection signal from the sensor 103 changes from the Low-level signal to the High-level signal.

In the above-described embodiment, the controller 130 starts measuring the transit time at a timing when the mounting of the ink cartridge 30 to the cartridge mounting portion 110 is completed, i.e., the detection signal from the mount sensor 107 changes from the Low-level signal to the High-level signal. Nevertheless, the timing when the controller 130 starts measuring the transit time is not limited thereto, and can be any timing.

Figure 11:
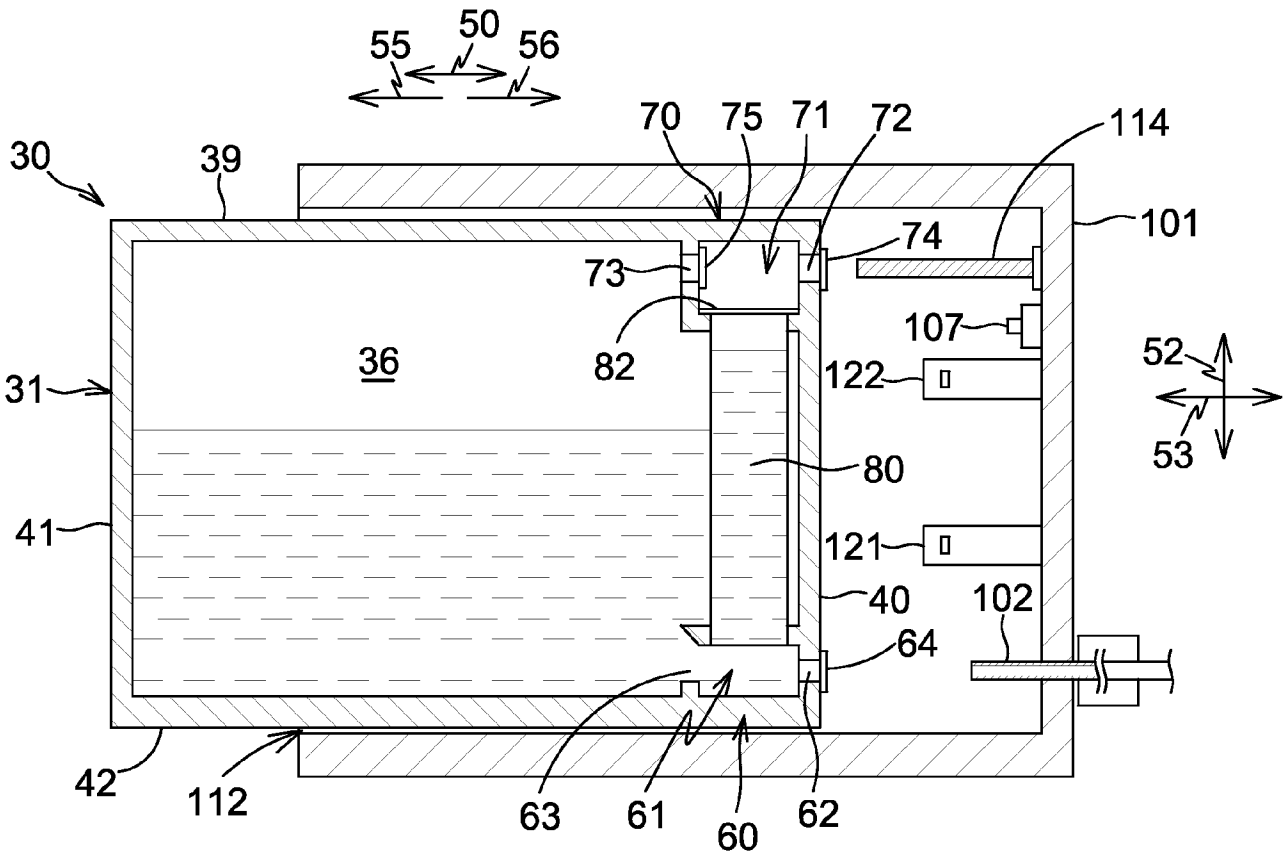
FIG. 11 is a cross-sectional view of an ink cartridge and a cartridge mounting portion according to a first modified embodiment, in which the ink cartridge does not contact a rod of the cartridge mounting portion.

For instance, referring to FIG. 11, a cartridge mounting portion 110 according to a first modified embodiment comprises a first optical sensor 121 and a second optical sensor 122 positioned away from each other in the height direction 52, and the first optical sensor 121 and second optical sensor 122 face the capillary portion 80 of the ink cartridge 30 mounted to the cartridge mounting portion 110. The first optical sensor 121 and the second optical sensor 122 have the same structure as the sensor 103. The controller 130 measures, as the transit time, a time from when the ink surface in the capillary portion 80 reaches the first optical sensor 121 to when the ink surface reaches the second optical sensor 122. In this first modified embodiment, the controller 130 starts measuring the transit time after the mounting of the ink cartridge 30 to the cartridge mounting portion 110 is completed. In another embodiment, the controller 130 may start measuring the transit time just before the mounting of the ink cartridge 30 the cartridge mounting portion 110 is completed.

In the above-described embodiment, the capillary portion 80 has a cross section along a plane parallel with the width direction 51 and the depth direction 53, i.e., along a horizontal plane. The dimension of the cross section in the depth direction 53 is greater than the dimension of the cross section in the width direction 51. In other words, the cross-sectional area of the capillary portion 80 along a plane perpendicular to the width direction 51 is greater than the cross sectional area of the capillary portion 80 along a plane perpendicular to the depth direction 53. In further other words, the cross-sectional area of the capillary portion 90 along a plane perpendicular to the optical path between the light emitting portion 104 and the light receiving portion 105 is relatively large. Therefore, ink in the detection portion in the capillary portion 80 blocks the light emitted by the light emitting portion 104 with more certainty. Nevertheless, the structure of the capillary portion 80 is not limited to the structure of the above-described embodiment.

Figure 12A:
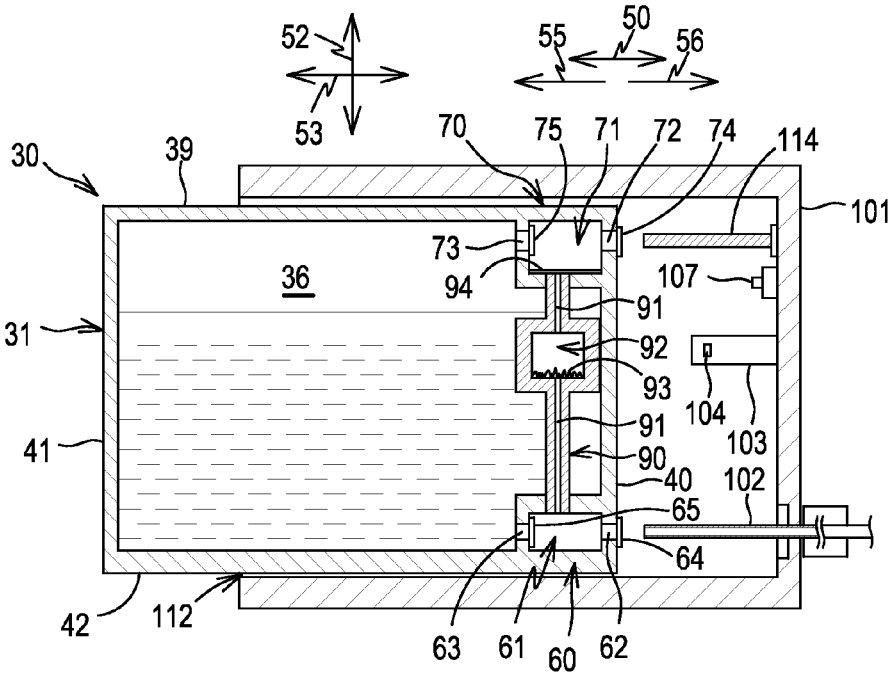
FIG. 12A is a cross-sectional view of an ink cartridge and a cartridge mounting portion according to a second modified embodiment during insertion of the ink cartridge into the cartridge mounting portion.
Figure 12B:
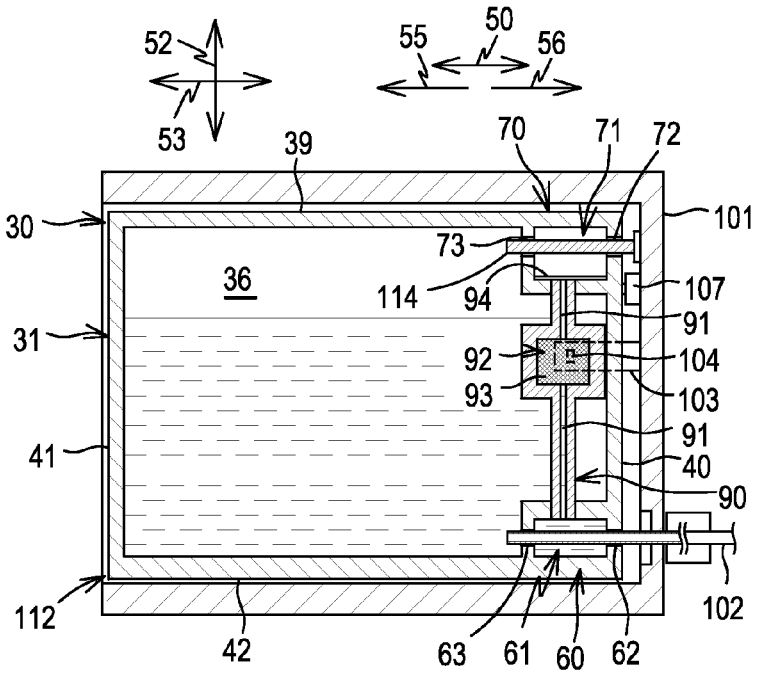
FIG. 12B is a cross-sectional view of the ink cartridge and the cartridge mounting portion according to the second modified embodiment when mounting of the ink cartridge to the cartridge mounting portion has been completed and a swell member absorbing ink has swollen.

For instance, referring to FIGS. 12A and 12B, an ink cartridge 30 according to a second modified embodiment comprises a closing member, e.g., a film 65, attached to the wall having the opening 63 formed therethrough. Before the ink cartridge 30 is mounted to the cartridge mounting portion 110, the opening 63 is closed by the film 65, such that the communication between the ink chamber 36 and the ink supply chamber 61 is blocked by the film 65. The hollow tube 102 is configured to contact the film 65 when the ink cartridge 30 is mounted to the cartridge mounting portion 110. The hollow tube 102 then ruptures the film 65. The ruptured portion of the film 65 moves to form an opening in the film 65 through which the hollow tube 102 is inserted. In other words, a portion of the film 65 is moved by the hollow tube 102. When the hollow tube 102 is inserted through the film 65 and the opening 63, the ink chamber 36 is brought into communication with the ink supply chamber 61.

The ink cartridge 30 according to this second modified embodiment comprises a capillary portion 90 instead of the capillary portion 80. The capillary portion comprises a capillary tube, or capillary 91, a chamber 92, and a swell member 93. The capillary 91 extends in the height direction 52 between the ink supply chamber 61 and the air communication chamber 71. The chamber 92 is provided at about the middle of the capillary 91 with respect to the height direction 52.

The lower end of the capillary 91 is connected to the ink supply chamber 61 between the opening 62 and the opening 63, and the upper end of the capillary 91 is connected to the air communication chamber 71 between the opening 72 and the opening 73. The cross-sectional area of the capillary 91 along a plane parallel with the width direction 51 and the depth direction 53 is small enough for ink to move from the lower end of the capillary 91 to the upper end of the capillary 91 by capillary force. The air permeable film 94 is provided at the upper end of the capillary 91. The chamber 92 is connected to the capillary 91, such that the capillary 91 is divided into an upper portion and a lower portion. The cross-sectional area of the chamber 92 along a plane parallel with the width direction 51 and the depth direction 53 is greater than the cross-sectional area of the capillary 91 along a plane parallel with the width direction 51 and the depth direction 53. The cross-sectional area of the chamber 92 along a plane parallel with the height direction 52 and the depth direction 53 is greater than the cross-sectional area of the capillary 91 along a plane parallel with the height direction 52 and the depth direction 53.

The swell member 93 is positioned in the chamber 92. The swell member 93 is configured to absorb ink by capillary force and swell. The swell member 93 may be sponge, foam, nonwoven fabric, etc.

Referring to FIG. 12A, before the ink cartridge 30 is mounted to the cartridge mounting portion 110, the communication between the ink chamber 36 and the ink supply chamber 61 is blocked by the film 65. Therefore, ink does not exist in the capillary portion 90, and the swell member is shrunk. Referring to FIG. 12B, when the ink cartridge 30 is mounted to the cartridge mounting portion 110, ink flows out of the ink chamber 36 to the outside of the ink cartridge 30 through the hollow tube 102 which has ruptured and penetrated through the film 65. Ink also enters the capillary portion 90 via the ink supply chamber 61 and moves up in the capillary portion 90. When ink reaches the chamber 92, the swell member 93 absorbs the ink and swell.

Referring to FIG. 12B, when the mounting of the ink cartridge 30 to the cartridge mounting portion 110 has been completed, the sensor 103 faces the chamber 92 in the width direction 51. More specifically, the sensor 103 does not face the swell member 93 which is shrunk, in the width direction 51, and faces the swell member 93 which has swollen, in the width direction 51. In other words, the chamber 92 is positioned between the light emitting portion 104 and the light receiving portion 105 in the width direction 51. More specifically, the swell member 93 which is shrunk does not intersect the optical path between the light emitting portion 104 and the light receiving portion 105 in the width direction 51. The swell member 93 which has swollen intersects the optical path between the light emitting portion 104 and the light receiving portion 105.

The controller 130 measures, as the transit time, a time from when the detection signal output from the mount sensor 107 changes from the Low-level signal to the High-level signal to when the detection signal output from the sensor 103 changes from the High-level signal to the Low-level signal, i.e., to when the swell member 93 swells to reach the detection position. In this second modified embodiment, the inside of the ink cartridge 30 does not necessarily need to be depressurized.

In the above-described embodiment, and the first and second modified embodiments, the lower end of the capillary portion 80 or 90 is connected to the ink supply chamber 61. The ink supply chamber 61 functions as a path through which ink flows from the ink chamber 36 to the outside of the ink cartridge 30 and as a path through which ink flows from the ink chamber 36 to the capillary portion 80 or 90 at the same time. Similarly, the upper end of the capillary portion 80 or 90 is connected to the air communication chamber 71. The air communication chamber 71 functions as path through which the ink chamber 36 is brought into communication with the atmosphere and as a path through which the capillary portion 80 or 90 is brought into communication with the atmosphere at the same time. As such, the structure of the ink cartridge 30 is simplified, and the ink cartridge 30 is downsized. Nevertheless, in another embodiment, the capillary portion 80 or 90 may be in communication with the ink chamber 36 though a path different and separate from the ink supply chamber 61, and the ink chamber 36 may be in communication with the atmosphere though a path different and separate from the air communication chamber 71.

In the above-described embodiment, and the first and second modified embodiments, the air permeable film 82, 94 is provided at the upper end of the capillary portion 80, 90. Nevertheless, the position of the air permeable film 82, 94 is not limited thereto. For instance, in another embodiment, the first and second modified embodiments, the air permeable film 82, 94 may be provided between the upper end and the lower end of the capillary portion 80, 90 to block liquid from flowing a lower portion of the capillary portion 80, 90 to an upper portion of the capillary portion 80, 90.

In another embodiment, the rubber plug 64, the film 65, the film 74, and the film 75 as closing members may be replaced with valves respectively. The valves function as closing members. The valves may move in the ink chamber 36, the ink supply chamber 61, and/or the air supply chamber 71 in the removal direction 55 when contacted and pushed by the hollow tube 102 and/or the rod 114, such that the opening 62, the opening 63, the opening 72, and/or the opening 73 is opened. When the hollow tube 102 and/or rod 114 separates from the valves, the valves may move in the ink chamber 36, the ink supply chamber 61, and/or the air supply chamber 71 in the insertion direction 56, such that the opening 62, the opening 63, the opening 72, and/or the opening 73 is closed. Moreover, in another embodiment, at least one of the rubber plug 64, the film 65, the film 74, and the film 75 may be replaced with a valve.

In another embodiment, the rubber plug 64 and the film 74 may be replaced with stickers attached to the front wall 40 as closing members, and the stickers may be removed by a user before the ink cartridge 30 is mounted to the cartridge mounting portion 110.

The transit time is an example of a physical quantity, based on which the velocity of ink moving in the capillary portion 80 or 90 can be specified. Nevertheless, the example of the physical quantity is not limited to the transit time. Another example of the physical quantity may be a distance ink moves in the capillary portion 80 or 90 during a predetermined period of time.

According to the above-described embodiment and the first and second modified embodiments, when the transit time is out of the threshold range (step S8: No), the controller 130 restricts the performance of the recording head 29, i.e., skips step S24. Therefore, a trouble of the recording head 21 which may be caused by an unusual viscosity of ink can be prevented. Nevertheless, it is not always necessary to skip step S24. In another embodiment, if the error flag is "ON" (step S22: Yes), the process of step S26 notifying a user of the information about the ink cartridge 30 may be performed, but the controller 130 may let the user decide whether image recording should be performed. In such a case, the processes performed by the controller 130 may be different from the ones of FIGS. 9 and 10, but the description thereof is omitted here.

Moreover, in another embodiment, if the error flag is "ON" (step S22: Yes), steps S23 and S24 may not be skipped, but the controller 130 may control the head control board 21A, such that the driving voltages applied to the piezoelectric actuators 29A are adjusted at step S24. More specifically, the controller 130 outputs different control signals to the heard control board 21A, such that the driving voltages applied to the piezoelectric actuators 29A are adjusted for the amounts of ink ejected from the nozzles 29 to be the same amount between when the transit time is within the threshold range and when the transit time is out of the threshold range. That is, when the transit time is below the lower limit value of the threshold range (it is estimated that the viscosity of ink is too low), the driving voltages are made smaller than the driving voltages when the transit time is within the threshold range. When the transit time is above the upper limit value of the threshold range (it is estimated that the viscosity of ink is too high), the driving voltages are made larger than the driving voltages when the transit time is within the threshold range. In this case, if a plurality of ink cartridges 30 storing inks having different viscosities is configured to be mounted to the same cartridge mounting portion 110, it is possible to drive the piezoelectric actuators 29A with suitable voltages according to types of ink. The actuators may not be limited to the piezoelectric actuators 29A, but may be thermal-type actuators, which ejects ink from the nozzles 29 by applying heat to ink and thereby generating bubbles in ink.

In addition to controlling the head control board 21A, such that the driving voltages applied to the piezoelectric actuators 29A are adjusted, the controller 130 may control a purge operation, in which ink is forcedly discharged from the nozzles 29 of the recording head 21. For instance, if the controller 130 determines that the error flag is set to "ON" (step S22: Yes), the controller 130 may control the purge operation, such that ink is discharged with more pressure applied thereto than if the controller 130 determines that the error flag is set to "OFF" (step S22: No). More specifically, when ink is discharged from the nozzles 29 of the recording head 21 by a suction pump, the controller 130 may control the suction pump, such that the suction pump sucks ink with more suction pressure if the error flag is set to "ON." With this control, air bubbles or thickened ink in the recording head 21 can be reliably discharged by the purge operation even if the viscosity of ink is high, and ink can be reliably supplied from the ink tube 20 to the recording head 21.

In the above-described embodiment, both of the upper limit value and the lower limit value of the threshold range are specified. Nevertheless, in another embodiment, at least one of the upper limit value and the lower limit value of the threshold range is specified.

The viscosity of ink changes when the surrounding temperature changes. When the temperature is high, the viscosity is low. When the temperature is low, the viscosity is high. The controller 130 may control the head control board 21A, such that the driving voltages applied to the piezoelectric actuators 29A are adjusted based on the temperature. More specifically, when the temperature is high, the controller 130 outputs control signals to the head control board 21A, such that low driving voltages are applied to the piezoelectric actuators 29A. When the temperature is low, the controller 130 outputs control signals to the head control board 21A, such that high driving voltages are applied to the piezoelectric actuators 29A. There is an optimum threshold range of the viscosity of ink, corresponding to the driving voltages applied to the piezoelectric actuators 29A which are determined by the temperature. In other word, it is preferable to set the threshold range of the viscosity of ink based on the temperature. Therefore, according to the above-described embodiment, the controller 130 determines the threshold range based on the temperature at step S7. How to determine the threshold range is not limited to a specific way, but the controller 130 may select one suitable threshold range based on the temperature out of a plurality of threshold ranges stored in the ROM 132, or may calculate the upper limit value or the lower limit value of the threshold range as a function of the temperature value. Nevertheless, step S7 for determining the threshold range based on the temperature may be removed, and a fixed threshold range can be used at step S8, when, for example, the driving voltages applied to the piezoelectric actuators 29A are not adjusted based on the temperature.

According to the above-described embodiment, the controller 130 stores the error flag in the EEPROM 134, but the controller 130 may store the error flag in a memory of an IC chip (not shown) mounted on the ink cartridge 30. According to the above-described embodiment, the controller 130 comprises the CPU 131 and the ASIC 135, but the controller 130 may not comprise the ASIC 135 and the CPU 131 may perform all the processes of FIGS. 10 and 9 by reading out a program stored in the ROM 132. On the contrary, the controller 130 may not comprise the CPU 131, and may comprise hardware only, such as the ASIC 135 or FPGA. Moreover, the controller 130 may comprise a plurality of CPUs 131 and/or a plurality of ASICs 135.

In the above-described embodiment and the first and second modified embodiments, ink is an example of liquid. Nevertheless, liquid is not limited to ink. For instance, liquid can be pre-treatment liquid which is ejected onto the sheet of paper before ink is ejected in printing.

In the above-described embodiment and the first and second modified embodiments, the ink cartridge 30 is manually mounted to the cartridge mounting portion 110. Nevertheless, how to mount the ink cartridge 30 to the cartridge mounting portion 110 is not limited to the manual mounting. An auto-loading mechanism can be provided to the cartridge mounting portion 110. For instance, with the auto-loading mechanism, a user has only to insert the ink cartridge 30 halfway into the cartridge mounting portion 110. Afterwards, the ink cartridge 30 is automatically moved in the insertion direction 56, and finally the mounting of the ink cartridge 30 to the cartridge mounting portion 110 is completed. Therefore, there is a reduced likelihood that the sensor 103 cannot detect the movement of the ink surface in the capillary portion 80 or 90 even if ink enters the capillary portion 80 or 90.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. A liquid cartridge comprising:

a liquid chamber configured to store liquid therein;

an air communication portion configured to selectively bring the liquid chamber into communication with the atmosphere outside the liquid cartridge; and a capillary portion having a first end configured to be in communication with the liquid chamber and a second end configured to be in communication with the atmosphere outside the liquid cartridge, wherein the capillary portion is configured to move the liquid from the first end to the second end therethrough by capillary force when the liquid chamber is brought into communication with the atmosphere outside the liquid cartridge via the air communication portion;

wherein the second end of the capillary portion is configured to be in communication with the atmosphere outside the liquid cartridge via the air communication portion, wherein the air communication portion comprises an air communication chamber having a first opening and a second opening, wherein the liquid cartridge further comprises a first closing member closing the first opening, such that communication between the air communication chamber and the outside of the liquid cartridge is blocked, and a second closing member closing the second opening, such that communication between the air communication chamber and the liquid chamber is blocked; and wherein the second end of the capillary portion is connected to the air communication chamber between the first opening and the second opening.

2. The liquid cartridge of claim 1, further comprising a liquid supply portion configured to selectively supply the liquid from the liquid chamber to the outside of the liquid cartridge;

wherein the first end of the capillary portion is configured to be in communication with the liquid chamber via the liquid supply portion, and the liquid supply portion comprises a liquid supply chamber having a third opening and a fourth opening, wherein the liquid cartridge further comprises a third closing member closing the third opening, such that communication between the liquid supply chamber and the outside of the liquid cartridge is blocked.

3. The liquid cartridge of claim 2, wherein the first end of the capillary portion is connected to the liquid supply chamber between the third opening and the fourth opening.

4. The liquid cartridge of claim 3, further comprising a fourth closing member closing the fourth opening, such that communication between the liquid supply chamber and the liquid chamber is blocked.

5. The liquid cartridge of claim 1, further comprising a liquid supply portion configured to selectively supply the liquid from the liquid chamber to the outside of the liquid cartridge;

wherein the first end of the capillary portion is configured to be in communication with the liquid chamber via the liquid supply portion, and the liquid supply portion comprises a liquid supply chamber having a third opening and a fourth opening, wherein the liquid cartridge further comprises a third closing member closing the third opening, such that communication between the liquid supply chamber and the outside of the liquid cartridge is blocked.

6. The liquid cartridge of claim 5, wherein the first end of the capillary portion is connected to the liquid supply chamber between the third opening and the fourth opening.

7. The liquid cartridge of claim 6, further comprising a fourth closing member closing the fourth opening, such that communication between the liquid supply chamber and the liquid chamber is blocked.

8. The liquid cartridge of claim 1, wherein the capillary portion has a cross section along a horizontal plane, and the cross section has a first dimension in a first direction and a second dimension in a second direction which is perpendicular to the first direction, wherein the first dimension is greater than the second dimension.

9. The liquid cartridge of claim 8, further comprising a liquid supply portion configured to selectively supply the liquid from the liquid chamber to the outside of the liquid cartridge;

wherein the liquid supply portion is aligned with the liquid chamber in the first direction.

10. The liquid cartridge of claim 9, wherein the capillary portion has a first cross-sectional area along a plane perpendicular to the second direction and a second cross-sectional area along a plane perpendicular to the first direction, wherein the first cross-sectional area is greater than the second cross-sectional area.

11. The liquid cartridge of claim 8, wherein the cross section has an elliptical shape.

12. The liquid cartridge of claim 1, wherein the capillary portion comprises a swell member configured to absorb the liquid and swell.

13. The liquid cartridge of claim 1, wherein the second end of the capillary portion is positioned above the first end of the capillary portion.

14. The liquid cartridge of claim 1, wherein the capillary portion has a first spatial size and the ink chamber has a second spatial size, wherein the first spatial size is less than the second spatial size.

15. The liquid cartridge of claim 1, further comprising an air permeable film at the second end of the capillary portion or at the capillary portion between the first end of the capillary portion and the second end of the capillary portion.

16. A liquid cartridge comprising:

a liquid chamber;

a capillary device having first and second ends, the first end in communication with the liquid chamber;

an air communication opening;

an air communication closing member having first and second configurations, in the first configuration the air communication opening is blocked, in the second configuration the air communication opening is open such that the second end of the capillary device is in communication with an atmosphere outside the liquid cartridge;

an air communication chamber having the air communication opening extending therethrough;

a first liquid communication opening extending between the air communication chamber and liquid chamber to selectively provide liquid communication between the air communication chamber and the liquid chamber;

wherein the second end of the capillary device is in communication with the air communication chamber;

a liquid supply chamber;

a first liquid supply opening defined by the liquid supply chamber;

a first liquid supply closing member having first and second configurations, in the first configuration the first liquid supply opening is blocked, in the second configuration the first liquid supply opening is open to outside the liquid chamber; and a second liquid supply opening in fluid communication with the liquid chamber;

wherein the first end of the capillary device is in communication with the liquid chamber via the second liquid supply opening.

17. The liquid cartridge of claim 16, further comprising:

a second liquid supply closing member having first and second configurations, in the first configuration the second liquid supply opening is blocked, in the second configuration the second liquid supply opening is open to provide the fluid communication with the liquid chamber.

18. The liquid cartridge of claim 17, further comprising:

a swell member in communication with the capillary device.

19. The liquid cartridge of claim 16, wherein the capillary device includes a plurality of capillaries.

20. The liquid cartridge of claim 16, further comprising:

liquid contained in the liquid chamber;

a liquid supply opening;

a liquid supply closing member having first and second configurations, in the first configuration the liquid supply opening is blocked, in the second configuration the liquid supply opening is open to allow liquid flow from the liquid chamber through liquid supply opening.

* * * * *